US009206676B2

(12) United States Patent
Quigley et al.

(10) Patent No.: US 9,206,676 B2
(45) Date of Patent: Dec. 8, 2015

(54) SYSTEM AND METHODS FOR REMOVING FLUIDS FROM A SUBTERRANEAN WELL

(75) Inventors: Peter A. Quigley, Duxbury, MA (US); Michael Feechan, Katy, TX (US)

(73) Assignee: FIBERSPAR CORPORATION, New Bedford, MA (US)

( * ) Notice: Subject to any disclaimer, the term of this patent is extended or adjusted under 35 U.S.C. 154(b) by 706 days.

(21) Appl. No.: 12/968,998

(22) Filed: Dec. 15, 2010

(65) Prior Publication Data

US 2011/0209879 A1 Sep. 1, 2011

Related U.S. Application Data

(60) Provisional application No. 61/286,648, filed on Dec. 15, 2009, provisional application No. 61/408,223, filed on Oct. 29, 2010.

(51) Int. Cl.
*E21B 43/12* (2006.01)

(52) U.S. Cl.
CPC ..... *E21B 43/128* (2013.01); *E21B 43/12* (2013.01); *E21B 43/122* (2013.01)

(58) Field of Classification Search
CPC ... E21B 43/124; E21B 43/126; E21B 43/128; E21B 43/129; E21B 43/25; E21B 43/12; E21B 43/121
USPC ..... 166/369, 372, 105
See application file for complete search history.

(56) References Cited

U.S. PATENT DOCUMENTS

| | | | |
|---|---|---|---|
| 87,993 | A | 3/1869 | Weston |
| 142,388 | A | 9/1873 | Goble |
| 396,176 | A | 1/1889 | Simpson |
| 418,906 | A | 1/1890 | Bosworth |
| 482,181 | A | 9/1892 | Kellom |
| 646,887 | A | 4/1900 | Stowe et al. |
| 749,633 | A | 1/1904 | Seeley |
| 1,234,812 | A | 7/1917 | Simmmons |
| 1,793,455 | A | 2/1931 | Buchanan |
| 1,890,290 | A | 12/1932 | Hargreaves |
| 1,930,285 | A | 10/1933 | Robinson |
| 2,099,407 | A | 11/1937 | Raymond |
| 2,178,931 | A | 11/1939 | Crites |
| 2,464,416 | A | 3/1949 | Raybould |

(Continued)

FOREIGN PATENT DOCUMENTS

| | | |
|---|---|---|
| BE | 559688 | 8/1957 |
| CA | 2282358 A1 | 8/1998 |

(Continued)

OTHER PUBLICATIONS

International Search Report and Written Opinion for PCT/US2010/060582 mailed on Feb. 16, 2011 (11 pages).

(Continued)

*Primary Examiner* — Elizabeth Gitlin
(74) *Attorney, Agent, or Firm* — Goodwin Procter LLP

(57) ABSTRACT

Systems and methods for removing fluids from a subterranean well are described. An example embodiment includes a system having a well casing surrounding at least one inner tubing string, where the inner tubing string has a distal section and a proximal section, an apparatus for removing a first fluid within the distal section of the inner tubing string, and an apparatus for removing a second fluid within the proximal section of the inner tubing string.

28 Claims, 6 Drawing Sheets

(56) References Cited

U.S. PATENT DOCUMENTS

| | | | |
|---|---|---|---|
| 2,467,520 | A | 4/1949 | Brubaker |
| 2,481,001 | A | 9/1949 | Burckle |
| 2,624,366 | A | 1/1953 | Pugh |
| 2,648,720 | A | 8/1953 | Alexander |
| 2,690,769 | A | 10/1954 | Brown |
| 2,725,713 | A | 12/1955 | Blanchard |
| 2,742,931 | A | 4/1956 | De Ganahl |
| 2,750,569 | A | 6/1956 | Moon |
| 2,810,424 | A | 10/1957 | Swartswelter et al. |
| 2,969,812 | A | 1/1961 | De Ganahl |
| 2,973,975 | A | 3/1961 | Ramberg et al. |
| 2,991,093 | A | 7/1961 | Guarnaschelli |
| 3,086,369 | A | 4/1963 | Brown |
| 3,116,760 | A | 1/1964 | Matthews |
| 3,167,125 | A | 1/1965 | Bryan |
| 3,170,137 | A | 2/1965 | Brandt |
| 3,212,528 | A | 10/1965 | Haas |
| 3,277,231 | A | 10/1966 | Downey et al. |
| 3,306,637 | A | 2/1967 | Press et al. |
| 3,334,663 | A | 8/1967 | Peterson |
| 3,354,292 | A | 11/1967 | Kahn |
| 3,354,992 | A | 11/1967 | Cook |
| 3,379,220 | A | 4/1968 | Kiuchi et al. |
| 3,383,223 | A | 5/1968 | Rose |
| 3,390,704 | A | 7/1968 | Woodell |
| 3,413,139 | A | 11/1968 | Krings |
| 3,459,229 | A | 8/1969 | Croft |
| 3,477,474 | A | 11/1969 | Mesler |
| 3,507,412 | A | 4/1970 | Carter |
| 3,522,413 | A | 8/1970 | Chrow |
| 3,526,086 | A | 9/1970 | Morgan |
| 3,554,284 | A | 1/1971 | Nystrom |
| 3,563,825 | A | 2/1971 | Segura |
| 3,579,402 | A | 5/1971 | Goldsworthy et al. |
| 3,589,135 | A | 6/1971 | Ede |
| 3,589,752 | A | 6/1971 | Spencer et al. |
| 3,604,461 | A | 9/1971 | Matthews |
| 3,606,396 | A | 9/1971 | Prosdocimo et al. |
| 3,606,402 | A | 9/1971 | Medney |
| 3,612,580 | A | 10/1971 | Jones |
| 3,654,967 | A | 4/1972 | Atwell et al. |
| 3,677,978 | A | 7/1972 | Dowbenko et al. |
| 3,685,860 | A | 8/1972 | Schmidt |
| 3,692,601 | A | 9/1972 | Goldsworthy et al. |
| 3,696,332 | A | 10/1972 | Dickson, Jr. et al. |
| 3,700,519 | A | 10/1972 | Carter |
| 3,701,489 | A | 10/1972 | Goldsworthy et al. |
| 3,728,187 | A | 4/1973 | Martin |
| 3,730,229 | A | 5/1973 | D'Onofrio |
| 3,734,421 | A | 5/1973 | Karlson et al. |
| 3,738,637 | A | 6/1973 | Goldsworthy et al. |
| 3,740,285 | A | 6/1973 | Goldsworthy et al. |
| 3,744,016 | A | 7/1973 | Davis |
| 3,769,127 | A | 10/1973 | Goldsworthy et al. |
| 3,773,090 | A | 11/1973 | Ghersa et al. |
| 3,776,805 | A | 12/1973 | Hansen |
| 3,783,060 | A | 1/1974 | Goldsworthy et al. |
| 3,790,438 | A | 2/1974 | Lewis et al. |
| 3,814,138 | A | 6/1974 | Courtot |
| 3,817,288 | A | 6/1974 | Ball |
| 3,828,112 | A | 8/1974 | Johansen et al. |
| 3,856,052 | A | 12/1974 | Feucht |
| 3,858,616 | A | 1/1975 | Thiery et al. |
| 3,860,040 | A | 1/1975 | Sullivan |
| 3,860,742 | A | 1/1975 | Medney |
| 3,866,633 | A | 2/1975 | Taylor |
| 3,901,281 | A | 8/1975 | Morrisey |
| 3,907,335 | A | 9/1975 | Burge et al. |
| 3,913,624 | A | 10/1975 | Ball |
| 3,932,559 | A | 1/1976 | Cantor et al. |
| 3,933,180 | A | 1/1976 | Carter |
| 3,955,601 | A | 5/1976 | Plummer, III |
| 3,956,051 | A | 5/1976 | Carter |
| 3,957,410 | A | 5/1976 | Goldsworthy et al. |
| 3,960,629 | A | 6/1976 | Goldsworthy |
| 3,963,377 | A | 6/1976 | Elliott et al. |
| 3,974,862 | A | 8/1976 | Fuhrmann et al. |
| 3,980,325 | A | 9/1976 | Robertson |
| RE29,112 | E | 1/1977 | Carter |
| 4,001,442 | A | 1/1977 | Stahlberger et al. |
| 4,007,070 | A | 2/1977 | Busdiecker |
| 4,013,101 | A | 3/1977 | Logan et al. |
| 4,032,177 | A | 6/1977 | Anderson |
| 4,048,807 | A | 9/1977 | Ellers et al. |
| 4,053,343 | A | 10/1977 | Carter |
| 4,057,610 | A | 11/1977 | Goettler et al. |
| 4,067,916 | A | 1/1978 | Jaeger |
| 4,095,865 | A | 6/1978 | Denison et al. |
| 4,104,095 | A | 8/1978 | Shaw |
| 4,108,701 | A | 8/1978 | Stanley |
| 4,111,237 | A | 9/1978 | Mutzner et al. |
| 4,111,469 | A | 9/1978 | Kavick |
| 4,114,393 | A | 9/1978 | Engle, Jr. et al. |
| 4,119,122 | A | 10/1978 | de Putter |
| 4,125,423 | A | 11/1978 | Goldsworthy |
| 4,133,972 | A | 1/1979 | Andersson et al. |
| 4,137,949 | A | 2/1979 | Linko, III et al. |
| 4,138,178 | A | 2/1979 | Miller et al. |
| 4,139,025 | A | 2/1979 | Carlstrom et al. |
| 4,148,963 | A | 4/1979 | Bourrain et al. |
| 4,190,088 | A | 2/1980 | Lalikos et al. |
| 4,196,307 | A | 4/1980 | Moore et al. |
| 4,200,126 | A | 4/1980 | Fish |
| 4,220,381 | A | 9/1980 | van der Graaf et al. |
| 4,226,446 | A | 10/1980 | Burrington |
| 4,229,613 | A | 10/1980 | Braun |
| 4,241,763 | A | 12/1980 | Antal et al. |
| 4,241,787 | A | 12/1980 | Price |
| 4,248,062 | A | 2/1981 | McLain et al. |
| 4,261,390 | A | 4/1981 | Belofsky |
| 4,273,160 | A | 6/1981 | Lowles |
| 4,303,263 | A | 12/1981 | Legris |
| 4,303,457 | A | 12/1981 | Johansen et al. |
| 4,306,591 | A | 12/1981 | Arterburn |
| 4,307,756 | A | 12/1981 | Voigt et al. |
| 4,308,999 | A | 1/1982 | Carter |
| 4,330,017 | A | 5/1982 | Satoh et al. |
| 4,336,415 | A | 6/1982 | Walling |
| 4,345,784 | A | 8/1982 | Walling |
| 4,351,364 | A | 9/1982 | Cocks |
| 4,380,252 | A | 4/1983 | Gray et al. |
| 4,385,644 | A | 5/1983 | Kaempen |
| 4,402,346 | A | 9/1983 | Cheetham et al. |
| 4,417,603 | A | 11/1983 | Argy |
| 4,421,806 | A | 12/1983 | Marks et al. |
| 4,422,801 | A | 12/1983 | Hale et al. |
| 4,434,816 | A | 3/1984 | Di Giovanni et al. |
| 4,445,734 | A | 5/1984 | Cunningham |
| 4,446,892 | A | 5/1984 | Maxwell |
| 4,447,378 | A | 5/1984 | Gray et al. |
| 4,463,779 | A | 8/1984 | Wink et al. |
| 4,469,729 | A | 9/1984 | Watanabe et al. |
| 4,476,923 | A | 10/1984 | Walling |
| 4,488,577 | A | 12/1984 | Shilad et al. |
| 4,507,019 | A | 3/1985 | Thompson |
| 4,515,737 | A | 5/1985 | Karino et al. |
| 4,522,058 | A | 6/1985 | Ewing |
| 4,522,235 | A | 6/1985 | Kluss et al. |
| 4,530,379 | A | 7/1985 | Policelli |
| 4,556,340 | A | 12/1985 | Morton |
| 4,567,916 | A | 2/1986 | Antal et al. |
| 4,578,675 | A | 3/1986 | MacLeod |
| 4,606,378 | A | 8/1986 | Meyer et al. |
| 4,627,472 | A | 12/1986 | Goettler et al. |
| 4,652,475 | A | 3/1987 | Haney et al. |
| 4,657,795 | A | 4/1987 | Foret et al. |
| 4,676,563 | A | 6/1987 | Curlett et al. |
| 4,681,169 | A | 7/1987 | Brookbank, III |
| 4,700,751 | A | 10/1987 | Fedrick |
| 4,706,711 | A | 11/1987 | Czvikovszky et al. |
| 4,712,813 | A | 12/1987 | Passerell et al. |
| 4,728,224 | A | 3/1988 | Salama et al. |
| 4,729,106 | A | 3/1988 | Rush et al. |
| 4,741,795 | A | 5/1988 | Grace et al. |

(56) References Cited

U.S. PATENT DOCUMENTS 4,758,455 A 7/1988 Campbell et al.
4,789,007 A 12/1988 Cretel et al.
4,842,024 A 6/1989 Palinchak
4,844,516 A 7/1989 Baker
4,849,668 A 7/1989 Crawley et al.
4,854,349 A 8/1989 Foreman
4,859,024 A 8/1989 Rahman
4,869,293 A 9/1989 Botsolas
4,903,735 A 2/1990 Delacour et al.
4,913,657 A 4/1990 Naito et al.
4,936,618 A 6/1990 Sampa et al.
4,941,774 A 7/1990 Harmstorf et al.
4,942,903 A 7/1990 Jacobsen et al.
4,972,880 A 11/1990 Strand
4,992,787 A 2/1991 Helm
4,995,761 A 2/1991 Barton
5,024,252 A 6/1991 Ochsner
5,048,572 A 9/1991 Levine
5,072,622 A 12/1991 Roach et al.
5,077,107 A 12/1991 Kaneda et al.
5,080,560 A 1/1992 LeRoy et al.
5,090,741 A 2/1992 Yokomatsu et al.
5,097,870 A 3/1992 Williams
5,123,453 A 6/1992 Robbins
5,156,206 A 10/1992 Cox
5,170,011 A 12/1992 Martucci
5,172,765 A 12/1992 Sas-Jaworsky et al.
5,176,180 A 1/1993 Williams et al.
5,182,779 A 1/1993 D'Agostino et al.
5,184,682 A 2/1993 Delacour et al.
5,188,872 A 2/1993 Quigley
5,209,136 A 5/1993 Williams
5,222,769 A 6/1993 Kaempen
5,257,663 A 11/1993 Pringle et al.
5,261,462 A 11/1993 Wolfe et al.
5,265,648 A 11/1993 Lyon
5,285,008 A 2/1994 Sas-Jaworsky et al.
5,285,204 A 2/1994 Sas-Jaworsky
5,330,807 A 7/1994 Williams
5,332,269 A 7/1994 Homm
5,334,801 A 8/1994 Mohn et al.
5,343,738 A 9/1994 Skaggs
5,346,658 A 9/1994 Gargiulo
5,348,088 A 9/1994 Laflin et al.
5,348,096 A 9/1994 Williams
5,351,752 A 10/1994 Wood et al.
RE34,780 E 11/1994 Trenconsky et al.
5,364,130 A 11/1994 Thalmann
5,373,870 A 12/1994 Derroire et al.
5,394,488 A 2/1995 Fernald et al.
5,395,913 A 3/1995 Bottcher et al.
5,398,729 A 3/1995 Spurgat
5,400,602 A 3/1995 Chang et al.
5,416,724 A 5/1995 Savic
5,423,353 A 6/1995 Sorensen
5,426,297 A 6/1995 Dunphy et al.
5,428,706 A 6/1995 Lequeux et al.
5,435,867 A 7/1995 Wolfe et al.
5,437,311 A 8/1995 Reynolds
5,437,899 A 8/1995 Quigley
5,443,099 A 8/1995 Chaussepied et al.
5,452,923 A 9/1995 Smith
5,457,899 A 10/1995 Chemello
5,460,416 A 10/1995 Freidrich et al.
RE35,081 E 11/1995 Quigley
5,469,916 A 11/1995 Sas-Jaworsky et al.
5,472,764 A 12/1995 Kehr et al.
5,494,374 A 2/1996 Youngs et al.
5,499,661 A 3/1996 Odru et al.
5,507,320 A 4/1996 Plumley
5,524,937 A 6/1996 Sides, III et al.
5,525,698 A 6/1996 Bottcher et al.
5,538,513 A 7/1996 Okajima et al.
5,551,484 A 9/1996 Charboneau
5,558,375 A 9/1996 Newman
5,622,211 A 4/1997 Martin et al.
5,641,956 A 6/1997 Vengsarkar et al.
5,671,811 A 9/1997 Head et al.
5,679,425 A 10/1997 Plumley
5,683,204 A 11/1997 Lawther
5,692,545 A 12/1997 Rodrigue
5,718,956 A 2/1998 Gladfelter et al.
5,730,188 A 3/1998 Kalman et al.
5,755,266 A 5/1998 Aanonsen et al.
5,758,990 A 6/1998 Davies et al.
5,778,938 A 7/1998 Chick et al.
5,785,091 A 7/1998 Barker, II
5,795,102 A 8/1998 Corbishley
5,797,702 A 8/1998 Drost et al.
5,798,155 A 8/1998 Yanagawa et al.
5,804,268 A 9/1998 Mukawa et al.
5,826,623 A 10/1998 Akiyoshi et al.
5,828,003 A 10/1998 Thomeer et al.
5,865,216 A 2/1999 Youngs
5,868,169 A 2/1999 Catallo
5,875,792 A 3/1999 Campbell, Jr. et al.
5,902,958 A 5/1999 Haxton
5,908,049 A 6/1999 Williams et al.
5,913,337 A 6/1999 Williams et al.
5,913,357 A 6/1999 Hanazaki et al.
5,921,285 A 7/1999 Quigley et al.
5,933,945 A 8/1999 Thomeer et al.
5,950,651 A 9/1999 Kenworthy et al.
5,951,812 A 9/1999 Gilchrist, Jr.
5,979,506 A 11/1999 Aarseth
5,984,581 A 11/1999 McGill et al.
5,988,702 A 11/1999 Sas-Jaworsky
6,004,639 A 12/1999 Quigley et al.
6,016,845 A 1/2000 Quigley et al.
6,032,699 A 3/2000 Cochran et al.
6,065,540 A 5/2000 Thomeer et al.
6,066,377 A 5/2000 Tonyali et al.
6,076,561 A 6/2000 Akedo et al.
6,093,752 A 7/2000 Park et al.
6,109,306 A 8/2000 Kleinert
6,123,110 A 9/2000 Smith et al.
6,136,216 A 10/2000 Fidler et al.
6,148,866 A 11/2000 Quigley et al.
RE37,109 E 3/2001 Ganelin
6,209,587 B1 4/2001 Hsich et al.
6,220,079 B1 4/2001 Taylor et al.
6,264,244 B1 7/2001 Isennock et al.
6,286,558 B1 9/2001 Quigley et al.
6,315,002 B1 11/2001 Antal et al.
6,328,075 B1 12/2001 Furuta et al.
6,334,466 B1 1/2002 Jani et al.
6,357,485 B2 3/2002 Quigley et al.
6,357,966 B1 3/2002 Thompson et al.
6,361,299 B1 3/2002 Quigley et al.
6,372,861 B1 4/2002 Schillgalies et al.
6,390,140 B2 5/2002 Niki et al.
6,397,895 B1 6/2002 Lively
6,402,430 B1 6/2002 Guesnon et al.
6,422,269 B1 7/2002 Johansson et al.
6,461,079 B1 10/2002 Beaujean et al.
6,470,915 B1 10/2002 Enders et al.
6,532,994 B1 3/2003 Enders et al.
6,538,198 B1 3/2003 Wooters
6,557,485 B1 5/2003 Sauter
6,557,905 B2 * 5/2003 Mack et al. ..... 285/330
6,561,278 B2 5/2003 Restarick et al.
6,585,049 B2 7/2003 Leniek, Sr.
6,604,550 B2 8/2003 Quigley et al.
6,620,475 B1 9/2003 Reynolds, Jr. et al.
6,631,743 B2 10/2003 Enders et al.
6,634,387 B1 10/2003 Glejbøl et al.
6,634,388 B1 10/2003 Taylor et al.
6,634,675 B2 10/2003 Parkes
6,663,453 B2 12/2003 Quigley et al.
6,691,781 B2 * 2/2004 Grant et al. ..... 166/265
6,706,348 B2 3/2004 Quigley et al.
6,706,398 B1 3/2004 Revis
6,746,737 B2 6/2004 Debalme et al.
6,764,365 B2 7/2004 Quigley et al.

(56) References Cited

U.S. PATENT DOCUMENTS

| | | | | |
|---|---|---|---|---|
| 6,773,774 | B1 | 8/2004 | Crook et al. | |
| 6,787,207 | B2 | 9/2004 | Lindstrom et al. | |
| 6,803,082 | B2 | 10/2004 | Nichols et al. | |
| 6,807,988 | B2 | 10/2004 | Powell et al. | |
| 6,807,989 | B2 | 10/2004 | Enders et al. | |
| 6,857,452 | B2 | 2/2005 | Quigley et al. | |
| 6,868,906 | B1 | 3/2005 | Vail, III et al. | |
| 6,889,716 | B2 | 5/2005 | Lundberg et al. | |
| 6,902,205 | B2 | 6/2005 | Bouey et al. | |
| 6,935,376 | B1 | 8/2005 | Taylor et al. | |
| 6,973,973 | B2 * | 12/2005 | Howard et al. | 166/372 |
| 6,978,804 | B2 | 12/2005 | Quigley et al. | |
| 6,983,766 | B2 | 1/2006 | Baron et al. | |
| 7,000,644 | B2 | 2/2006 | Ichimura et al. | |
| 7,021,339 | B2 | 4/2006 | Hagiwara et al. | |
| 7,025,580 | B2 | 4/2006 | Heagy et al. | |
| 7,029,356 | B2 | 4/2006 | Quigley et al. | |
| 7,069,956 | B1 | 7/2006 | Mosier | |
| 7,080,667 | B2 | 7/2006 | McIntyre et al. | |
| 7,152,632 | B2 | 12/2006 | Quigley et al. | |
| 7,234,410 | B2 | 6/2007 | Quigley et al. | |
| 7,243,716 | B2 | 7/2007 | Denniel et al. | |
| 7,285,333 | B2 | 10/2007 | Wideman et al. | |
| 7,306,006 | B1 | 12/2007 | Cornell | |
| 7,328,725 | B2 | 2/2008 | Henry et al. | |
| 7,498,509 | B2 | 3/2009 | Brotzell et al. | |
| 7,523,765 | B2 | 4/2009 | Quigley et al. | |
| 7,600,537 | B2 | 10/2009 | Bhatnagar et al. | |
| 7,647,948 | B2 | 1/2010 | Quigley et al. | |
| 8,187,687 | B2 | 5/2012 | Wideman et al. | |
| 2001/0006712 | A1 | 7/2001 | Hibino et al. | |
| 2001/0013669 | A1 | 8/2001 | Cundiff et al. | |
| 2001/0025664 | A1 | 10/2001 | Quigley et al. | |
| 2002/0040910 | A1 | 4/2002 | Pahl | |
| 2002/0081083 | A1 | 6/2002 | Griffioen et al. | |
| 2002/0094400 | A1 | 7/2002 | Lindstrom et al. | |
| 2002/0119271 | A1 | 8/2002 | Quigley et al. | |
| 2002/0185188 | A1 | 12/2002 | Quigley et al. | |
| 2003/0008577 | A1 | 1/2003 | Quigley et al. | |
| 2003/0087052 | A1 | 5/2003 | Wideman et al. | |
| 2004/0014440 | A1 | 1/2004 | Makela et al. | |
| 2004/0025951 | A1 | 2/2004 | Baron et al. | |
| 2004/0052997 | A1 | 3/2004 | Santo | |
| 2004/0074551 | A1 | 4/2004 | McIntyre | |
| 2004/0094299 | A1 | 5/2004 | Jones | |
| 2004/0096614 | A1 | 5/2004 | Quigley et al. | |
| 2004/0134662 | A1 | 7/2004 | Chitwood et al. | |
| 2004/0226719 | A1 | 11/2004 | Morgan et al. | |
| 2004/0265524 | A1 | 12/2004 | Wideman et al. | |
| 2005/0087336 | A1 | 4/2005 | Surjaatmadja et al. | |
| 2005/0189029 | A1 | 9/2005 | Quigley et al. | |
| 2006/0000515 | A1 | 1/2006 | Huffman | |
| 2006/0054235 | A1 | 3/2006 | Cohen et al. | |
| 2006/0144456 | A1 | 7/2006 | Donnison et al. | |
| 2006/0249508 | A1 | 11/2006 | Teufl et al. | |
| 2007/0040910 | A1 | 2/2007 | Kuwata | |
| 2007/0125439 | A1 | 6/2007 | Quigley et al. | |
| 2007/0154269 | A1 | 7/2007 | Quigley et al. | |
| 2007/0187103 | A1 | 8/2007 | Crichlow | |
| 2007/0246459 | A1 | 10/2007 | Loveless et al. | |
| 2007/0296209 | A1 | 12/2007 | Conley et al. | |
| 2008/0006337 | A1 | 1/2008 | Quigley et al. | |
| 2008/0006338 | A1 | 1/2008 | Wideman et al. | |
| 2008/0014812 | A1 | 1/2008 | Quigley et al. | |
| 2008/0164036 | A1 | 7/2008 | Bullen | |
| 2008/0185042 | A1 | 8/2008 | Feechan et al. | |
| 2008/0210329 | A1 | 9/2008 | Quigley et al. | |
| 2009/0090460 | A1 | 4/2009 | Wideman et al. | |
| 2009/0107558 | A1 | 4/2009 | Quigley et al. | |
| 2009/0173406 | A1 | 7/2009 | Quigley et al. | |
| 2009/0194293 | A1 | 8/2009 | Stephenson et al. | |
| 2009/0278348 | A1 | 11/2009 | Brotzell et al. | |
| 2009/0295154 | A1 | 12/2009 | Weil et al. | |
| 2010/0101676 | A1 | 4/2010 | Quigley et al. | |
| 2010/0212769 | A1 | 8/2010 | Quigley et al. | |
| 2010/0218944 | A1 | 9/2010 | Quigley et al. | |
| 2011/0147492 | A1 | 6/2011 | Gilpatrick | |
| 2012/0043088 | A1 * | 2/2012 | McAllister et al. | 166/325 |
| 2012/0216903 | A1 | 8/2012 | Osborne | |

FOREIGN PATENT DOCUMENTS

| | | | |
|---|---|---|---|
| CH | 461199 | | 8/1968 |
| DE | 1959738 | | 6/1971 |
| DE | 3603597 | | 8/1987 |
| DE | 4040400 | A1 | 8/1992 |
| DE | 4214383 | C1 | 9/1993 |
| DE | 19905448 | A1 | 8/2000 |
| DE | 102005061516 | A1 | 7/2007 |
| DE | 202008007137 | U1 | 10/2008 |
| EP | 0024512 | | 3/1981 |
| EP | 0203887 | A2 | 12/1986 |
| EP | 352148 | | 1/1990 |
| EP | 0427306 | A2 | 5/1991 |
| EP | 0 477 704 | | 1/1992 |
| EP | 0477704 | A1 | 4/1992 |
| EP | 0503737 | A1 | 9/1992 |
| EP | 0505815 | A2 | 9/1992 |
| EP | 0536844 | A1 | 4/1993 |
| EP | 0681085 | A2 | 11/1995 |
| EP | 0854029 | A2 | 7/1998 |
| EP | 0953724 | A2 | 11/1999 |
| EP | 0970980 | | 1/2000 |
| EP | 0981992 | A1 | 3/2000 |
| FR | 989204 | | 9/1951 |
| GB | 553110 | | 5/1943 |
| GB | 809097 | | 2/1959 |
| GB | 909187 | | 10/1962 |
| GB | 956500 | | 4/1964 |
| GB | 1297250 | | 11/1972 |
| GB | 2103744 | A | 2/1983 |
| GB | 2159901 | A | 12/1985 |
| GB | 2193006 | A | 1/1988 |
| GB | 2255994 | A | 11/1992 |
| GB | 2270099 | A | 3/1994 |
| GB | 2365096 | | 2/2002 |
| JP | 163 592 | | 6/1990 |
| WO | WO-8704768 | | 8/1987 |
| WO | WO-9113925 | | 9/1991 |
| WO | WO-9221908 | | 12/1992 |
| WO | WO-9307073 | A1 | 4/1993 |
| WO | WO-93119927 | | 10/1993 |
| WO | WO-9502782 | A1 | 1/1995 |
| WO | WO-9512115 | A2 | 4/1995 |
| WO | WO-9712166 | A1 | 4/1997 |
| WO | WO-97/48932 | A1 | 12/1997 |
| WO | WO-9919653 | A1 | 4/1999 |
| WO | WO-99/61833 | A1 | 12/1999 |
| WO | WO-00/09928 | A1 | 2/2000 |
| WO | WO-0031458 | A1 | 6/2000 |
| WO | WO-00/73695 | A1 | 12/2000 |
| WO | WO-2006/003208 | A1 | 1/2006 |

OTHER PUBLICATIONS

International Search Report mailed on Jan. 22, 2001.

International Search Report mailed on Mar. 5, 2001.

International Search Report mailed on Nov. 8, 2005.

Austigard E. and R. Tomter ; "Composites Subsea: Cost Effective Products; an Industry Challenge", Subsea 94 International Conference, the 1994 Report on Subsea Engineering: The Continuing Challenges.

Connell Mike et al.; "Coiled Tubing: Application for Today's Challenges", Petroleum Engineer International, pp. 18-21 (Jul. 1999).

Feechan Mike et al.; "Spoolable Composites Show Promise", The American Oil & Gas Reporter, pp. 44-50 (Sep. 1999).

Fowler Hampton et al.; "Development Update and Applications of an Advanced Composite Spoolable Tubing", Offshore Technology Conference held in Houston Texas from May 4-7, 1998, pp. 157-162.

Fowler Hampton; "Advanced Composite Tubing Usable", The American Oil & Gas Reporter, pp. 76-81 (Sep. 1997).

(56) References Cited

OTHER PUBLICATIONS

Hahn H. Thomas and Williams G. Jerry; "Compression Failure Mechanisms in Unidirectional Composites". NASA Technical Memorandum pp. 1-42 (Aug. 1984).
Hansen et al.; "Qualification and Verification of Spoolable High Pressure Composite Service Lines for the Asgard Field Development Project", paper presented at the 1997 Offshore Technology Conference held in Houston Texas from May 5-8, 1997, pp. 45-54.
Hartman, D.R., et al., "High Strength Glass Fibers," Owens Coming Technical Paper (Jul. 1996).
Haug et al.; "Dynamic Umbilical with Composite Tube (DUCT)", Paper presented at the 1998 Offshore Technology Conference held in Houston Texas from 4th to 7th, 1998; pp. 699-712.
Lundberg et al.; "Spin-off Technologies from Development of Continuous Composite Tubing Manufacturing Process", Paper presented at the 1998 Offshore Technology Conference held in Houston, Texas from May 4-7, 1998 pp. 149-155.
Marker et al.; "Anaconda: Joint Development Project Leads to Digitally Controlled Composite Coiled Tubing Drilling System", Paper presented at the SPEI/COTA, Coiled Tubing Roundtable held in Houston, Texas from Apr. 5-6, 2000, pp. 1-9.
Measures et al.; "Fiber Optic Sensors for Smart Structures", Optics and Lasers Engineering 16: 127-152 (1992).
Measures R. M.; "Smart Structures with Nerves of Glass". Prog. Aerospace Sci. 26(4): 289-351 (1989).
Moe Wood T. et al.; "Spoolable, Composite Piping for Chemical and Water Injection and Hydraulic Valve Operation", Proceedings of the 11th International Conference on Offshore Mechanics and Arctic Engineering-I992-, vol. III, Part A—Materials Engineering, pp. 199-207 (1992).
Poper Peter; "Braiding", International Encyclopedia of Composites, Published by VGH, Publishers, Inc., 220 East 23rd Street, Suite 909, New York, NY 10010.
Quigley et al.; "Development and Application of a Novel Coiled Tubing String for Concentric Workover Services", Paper presented at the 1997 Offshore Technology Conference held in Houston, Texas from May 5-8, 1997, pp. 189-202.
Rispler K. et al.; "Composite Coiled Tubing in Harsh Completion/Workover Environments", Paper presented at the SPE GAS Technology Symposium and Exhibition held in Calgary, Alberta, Canada, on Mar. 15-18, 1998, pp. 405-410.
Sas-Jaworsky II Alex.; "Developments Position CT for Future Prominence", The American Oil & Gas Reporter, pp. 87-92 (Mar. 1996).
Sas-Jaworsky II and Bell Steve "Innovative Applications Stimulate Coiled Tubing Development", World Oil, 217(6): 61 (Jun. 1996).
Sas-Jaworsky II and Mark Elliot Teel; "Coiled Tubing 1995 Update: Production Applications", World Oil, 216 (6): 97 (Jun. 1995 ).
Sas-Jaworsky, A. and J.G. Williams, "Advanced composites enhance coiled tubing capabilities", World Oil, pp. 57-69 (Apr. 1994).
Sas-Jaworsky, A. and J.G. Williams, "Development of a composite coiled tubing for oilfield services", Society of Petroleum Engineers, SPE 26536, pp. 1-11 (1993).
Sas-Jaworsky, A. and J.G. Williams, "Enabling capabilities and potential applications of composite coiled tubing", Proceedings of World Oil's 2nd International Conference on Coiled Tubing Technology, pp. 2-9 (1994).
Shuart J. M. et al.; "Compression Behavior of ≠45o-Dominated Laminates with a Circular Hole or Impact Damage", AIAA Journal 24(1):115-122 (Jan. 1986).
Silverman A. Seth; "Spoolable Composite Pipe for Offshore Applications", Materials Selection & Design pp. 48-50 (Jan. 1997).
Williams G. J. et al.; "Composite Spoolable Pipe Development, Advancements, and Limitations", Paper presented at the 2000 Offshore Technology Conference held in Houston Texas from May 1-4, 2000, pp. 1-16.
Williams, J.G., "Oil Industry Experiences with Fiberglass Components," Offshore Technology Conference, 1987, pp. 211-220.
Sperling, L.H., "Introduction to Physical Polymer Science 3rd Edition," Wiley-Interscience, New York, NY, 2001, p. 100.
Fiberspar Tech Notes, "Horizontal well deliquification just got easier-with Fiberspar Spoolable Production Systems," TN21-R1UN1-HybridLift, 2010, 2 pages.
Dalmolen "The Properties, Qualification, and System Design of, and Field Experiences with Reinforced Thermoplastic Pipe for Oil and Gas Applications" NACE International, 2003 West Conference (Feb. 2003), 11 pages.
International Search Report and Written Opinion for International Patent Application No. PCT/US2013/054533 mailed on Nov. 29, 2013, 13 pages.
Mesch, K.A., "Heat Stabilizers," Kirk-Othmer Encyclopedia of Chemical Technology, 2000 pp. 1-20.

* cited by examiner

SYSTEM AND METHODS FOR REMOVING FLUIDS FROM A SUBTERRANEAN WELL

RELATED APPLICATIONS

The current application claims the benefit of U.S. Provisional Application Nos. 61/286,648 filed Dec. 15, 2009 and 61/408,223 filed Oct. 29, 2010. Each of the aforementioned patent applications is incorporated herein by reference.

FIELD

The present invention relates generally to the field of fluid transport, and more particularly to methods and devices for removing fluids from a subterranean well.

BACKGROUND

Producing hydrocarbons from a subterranean well often requires the separation of the desired hydrocarbons, either in liquid or gaseous form, from unwanted liquids, e.g., water, located within the well and mixed with the desired hydrocarbons. If there is sufficient gas reservoir pressure and flow within the well, the unwanted liquids can be progressively removed from the well by the hydrocarbon gas flow, and thereafter separated from the desired hydrocarbons at the surface. However, in lower pressure gas wells, the initial reservoir pressure may be insufficient to allow the unwanted liquids to be lifted to the surface along with the desired hydrocarbons, or the reservoir pressure may decay over time such that, while initially sufficient, the pressure decreases over time until it is insufficient to lift both the hydrocarbons and undesired liquid to the surface. In these cases, artificial lift methods of assisting the removal of the fluids are required.

More particularly, in gas wells where the reservoir pressure is insufficient to carry the unwanted liquids to the surface along with the gas, the unwanted liquids will not be carried up the wellbore by the gas, but will rather gather in the well bore. The back pressure created by this liquid column will reduce and may block the flow of gas to the surface, thereby completely preventing any gas production from the well. Even in cases where the initial reservoir gas pressure is sufficiently high to remove the unwanted liquids, this pressure will decay over time and the wells will reach a point where economic production is not possible without a system for assisting in the removal of the unwanted liquids from the well bore, otherwise known as deliquification. Deliquification by artificial lift is therefore a requirement in most gas producing wells. A very similar situation exists in low pressure oil wells, where the well pressure may be insufficient to lift the produced oil to the surface.

A number of methods are known for assisting the lift of liquids in hydrocarbon wells to the surface, including, but not limited to, reciprocating rod pumps, submersible electric pumps, progressive cavity pumps, plungers and gas lifts. However, in some cases, for example in gas producing shales where permeability is low, it is necessary to drill these wells with deviated well sections (i.e., sections extending at an angle from the main, substantially vertical, bore) using horizontal drilling technology which exposes greater amounts of the producing formation, thereby making the well commercially viable. The length of the horizontal section of such wells can make artificial lift of the liquids both expensive and technically difficult using currently available technology. For example, reciprocating rod pumps and large electrical pumps cannot easily be placed, driven, or otherwise operated in a long horizontal, or substantially horizontal, section of a well bore, while devices such as plungers generally fall using gravity only, and cannot therefore get to the end of a horizontal section. The pump may have to be large to overcome the entire static pressure head within the system.

SUMMARY

In view of the foregoing, there is a need for improved methods and systems for deliquifying subterranean wells (i.e., removing fluids from a subterranean well) to assist in the recovery of hydrocarbons and other valuable fluids, especially in subterranean wells including deviated well sections.

The present invention includes methods and systems for efficiently removing unwanted liquids from a subterranean well, thereby assisting the recovery of desirable fluids from the well, using a hybrid deliquification system including multiple fluid removal means.

In one aspect, the invention includes a system for removing fluids from a subterranean well. The system includes an inner tubing string with a distal section and a proximal section, a first fluid removal means within the distal section of the inner tubing string, and a second fluid removal means within the proximal section of the inner tubing string.

In one embodiment, the first and second fluid removal means are adapted to operate sequentially. In another embodiment, at least a portion of the distal section is substantially horizontally oriented, and/or at least a portion of the proximal section is substantially vertically oriented. At least part of this distal portion may be oriented at an acute angle to a horizontal plane. The distal section and the proximal may both be substantially vertically oriented. The system may optionally have a well casing surrounding the inner tubing string.

In another embodiment, the first fluid removal means may be located within the well casing at a distal portion of the inner tubing string. The well casing may include a producing zone, e.g., at least one selectively perforated portion to allow ingress of fluids from outside the casing. The producing zone may be proximate the first fluid removal means. The system may include a wellhead located at a proximal end of at least one of the inner tubing string and the well casing.

The system may include at least one power supply to power at least one of the first fluid removal means and second fluid removal means. The at least one power supply may include at least one of an electrical power supply, a gas power supply, a compressed gas power supply, or a hydraulic power supply. The compressed gas power supply may supply compressed gas to the second fluid removal means via capillary tubes. In one embodiment, the second fluid removal means includes a bladder adapted to be squeezed by the supplied compressed gas. In another embodiment, the second fluid removal means includes a piston adapted to be driven by the supplied compressed gas. In yet another embodiment, the second fluid removal means includes a jet pump adapted to use the supplied compressed gas to directly move fluid.

In still another embodiment, the system for removing fluids includes a control system for controlling operation of at least one of the first fluid removal means and the second fluid removal means. The control system may be adapted to monitor system parameters. The system parameters may be a current, a voltage, a gas flow, a fluid flow, a pressure, and/or a temperature. The control system may be adapted to respond to a status of the monitored parameters by controlling, adjusting, and/or optimizing a frequency, a timing, and/or a duration of the sequential operation of the first and the second fluid removal means.

In other embodiments, the system includes a pipe within the well and surrounding the inner tubing string. An injected gas may flow through the inner tubing string and a fluid may flow through a pipe annulus between the inner tubing string and the pipe. A produced gas may flow through a well casing annulus between the well casing and the pipe. The injected gas may be restricted to the inner tubing string. In another embodiment, the system includes a crossover device adapted to re-route the injected gas and the fluid. Each of the injected gas and the fluid may flow through different portions of the inner tubing string.

In one embodiment, the inner tubing string is adapted to transport at least one unwanted liquid, while an annulus between the inner tubing string and the well casing may be adapted to transport at least one desired fluid. The first fluid removal means may be adapted to pump unwanted liquid from the inner tubing string into the annulus, or alternatively, from the annulus into the inner tubing string. In an alternative embodiment, the inner tubing string is adapted to transport at least one desired fluid, while an annulus between the inner tubing string and the well casing is adapted to transport at least one unwanted liquid.

The desired fluid to be removed from the subterranean well may include, or consist essentially of, one or more gases and/or one or more liquids. In one embodiment, the desired fluid to be removed from the subterranean well includes one or more hydrocarbons. The first fluid removal means may be adapted to pump unwanted liquid from the distal section to the second fluid removal means, while the second fluid removal means may be adapted to pump unwanted liquid within the second section to a proximal end of at least one of the inner tubing string and the annulus.

In one embodiment, the first fluid removal means and/or second fluid removal means includes at least one of a mechanical pump, reciprocating rod pump, submersible electric pump, progressive cavity pump, plunger, compressed gas pumping system, and/or gas lift. A plunger may include a valve element adapted to allow unwanted liquid from the distal portion of the inner tubing string to pass through the plunger towards a proximal end of the inner tubing string. The plunger may, for example, be driven by a compressed gas supply coupled to the proximal end of the inner tubing string. The first fluid removal means and second fluid removal means may be of the same form, or be of different forms. For example, the first fluid removal means may include an electric submersible pump, while the second fluid removal means includes a plunger lift.

In one embodiment, the system may include at least one valve between the first fluid removal means and the second fluid removal means, and/or at least one valve between the second fluid removal means and a proximal end of the inner tubing string. The inner tubing string may be a single continuous spoolable tube or have a plurality of connected spoolable tubing sections. In one embodiment, the inner tubing string is a multi-layered tube.

In one embodiment, the second fluid removal means is adapted to provide a greater pumping power than the first fluid removal means. For example, the first fluid removal means may only require enough power to transport fluid from a distal end of the inner tubing string and/or annulus to the proximal section of the inner tubing string and/or annulus and, for example to the location of the second fluid removal means. The second fluid removal means, in certain embodiments, has sufficient power to transport the fluid to the surface. The first fluid removal means and second fluid removal means may be adapted to operate concurrently, or to operate discretely (i.e., separately at different discrete intervals). The first fluid removal means and/or second fluid removal means may also be adapted to operate continuously or intermittently (i.e., on a regular or irregular cycle, or in response to a monitored condition being sensed).

Another aspect of the invention includes a method of removing fluids from a subterranean well. The method includes the step of inserting at least one inner tubing string through a well with an optional one or more well casings, wherein the well has a distal portion that extends into a fluid source within a rock formation and includes a proximal well section extending from a surface of the rock formation and a deviated well section extending from the proximal well section to the fluid source. The method further includes the steps of transporting at least one unwanted liquid through the inner tubing string from the fluid source to the proximal well section using a first fluid removal means, transporting the at least one unwanted liquid through the inner tubing string from the proximal well section to a proximal end of the inner tubing string using a second fluid removal means, and transporting a desired fluid from the fluid source to the proximal end of the well casing through an annulus between the inner tubing string and the well casing.

In one embodiment, at least a portion of the deviated well section is substantially horizontally oriented, and/or at least a portion of the proximal well section is substantially vertically oriented. The first fluid removal means may be located within the well at a distal portion of the inner tubing string. The distal portion of the deviated well section may be oriented at an acute angle to a horizontal plane. The well casing may include a producing zone proximate the first fluid removal means such as, for example, at least one selectively perforated portion to allow ingress of fluids from outside the casing. Each of the first fluid removal means and the second fluid removal means may be a mechanical pump, a reciprocating rod pump, a submersible electric pump, a progressive cavity pump, a plunger, a compressed gas pumping system, and/or a gas lift.

The first fluid removal means and second fluid removal means may have the same form, or have different forms. For example, the first fluid removal means may include an electric submersible pump, while the second fluid removal means may include a plunger lift. The inner tubing string may be a single continuous spoolable tube or a plurality of connected spoolable tubing sections. In one embodiment, the inner tubing string is a multi-layered tube.

One embodiment includes monitoring at least one property of at least one of the unwanted liquid and the desired fluid. The monitored property may include at least one of a pressure, a temperature, a flow rate, and/or a chemical composition. The method may include controlling an operation of at least one of the first fluid removal means and the second fluid removal means using a controlling means. The controlling means may, for example, provide power to at least one of the first fluid removal means and the second fluid removal means.

The controlling means may, for example, power at least one of the first fluid removal means and the second fluid removal means in response to at least one monitored condition within at least one of the inner tubing string and the well casing. The step of transporting the at least one unwanted liquid through the inner tubing string from the proximal well section to the proximal end of the inner tubing string using a second fluid removal means may be performed when a predetermined volume of unwanted liquid is detected within the proximal well section of the inner tubing string. In one embodiment, the second fluid removal means provides a greater pumping power than the first fluid removal means. One embodiment may include at least one valve within the inner tubing string between the first fluid removal means and the second fluid removal means, and/or at least one valve within the inner tubing string between the second fluid removal means and a proximal end of the inner tubing string. The desired fluid may include a gas and/or liquid. The desired fluid may, for example, be a hydrocarbon.

Another aspect of the invention includes a method of removing fluids from a subterranean well including the step of inserting at least one inner tubing string through a well with an optional one or more well casings, wherein the well has a distal portion that extends into a fluid source within a rock formation and includes a proximal well section extending from a surface of the rock formation and a deviated well section extending from the proximal well section to the fluid source. The method may include transporting at least one unwanted liquid through an annulus between the inner tubing string and the well from the fluid source to the proximal well section using a first fluid removal means, transporting the at least one unwanted liquid through the annulus from the proximal well section to a proximal end of the well using a second fluid removal means, and transporting a desired fluid from the fluid source to the proximal end of the well casing through the inner tubing string.

Yet another aspect of the invention includes a combined sequential lift system for removing water from a well bore with a first substantially vertical section. The system includes an inner tube located in the well bore, a primary pump system located in the first substantially vertical section capable of lifting water to a wellhead, a secondary pump system capable of removing water from the well bore hole into the inner tube, and a system sequencer that sequentially controls, adjusts and/or optimizes the operation of the primary and the secondary pump system.

In one embodiment, the primary pump system is a plunger. In another embodiment, the primary pump system is a reciprocating pump. The reciprocating pump may be a beam pump. In yet another embodiment, the secondary pump system is attached to the inner tube and comprises check valves. The secondary pump system may be located in a horizontal or a deviated section of the well bore, and may include a compressed gas pump and a compressed gas. The compressed gas pump may lift water to the primary system by including a bladder capable of being squeezed by the compressed gas and/or a piston driven by the compressed gas. The compressed gas pump may include a jet pump, wherein the compressed gas directly moves the water to the primary pump system.

In other embodiments, the system sequencer monitors well parameters to control the frequency and/or timing of the primary and secondary pump systems. The combined sequential lift system may include a cross-over system to re-route the water from the inner tube. The cross-over system may be placed at a set point in the well bore and attached to the inner tube to provide channels reversing flow of the water and the compressed gas.

These and other objects, along with advantages and features of the present invention, will become apparent through reference to the following description, the accompanying drawings, and the claims. Furthermore, it is to be understood that the features of the various embodiments described herein are not mutually exclusive and may exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

In the following description, various embodiments of the present invention are described with reference to the following drawings, in which.

DETAILED DESCRIPTION OF THE INVENTION

Figure 1A:
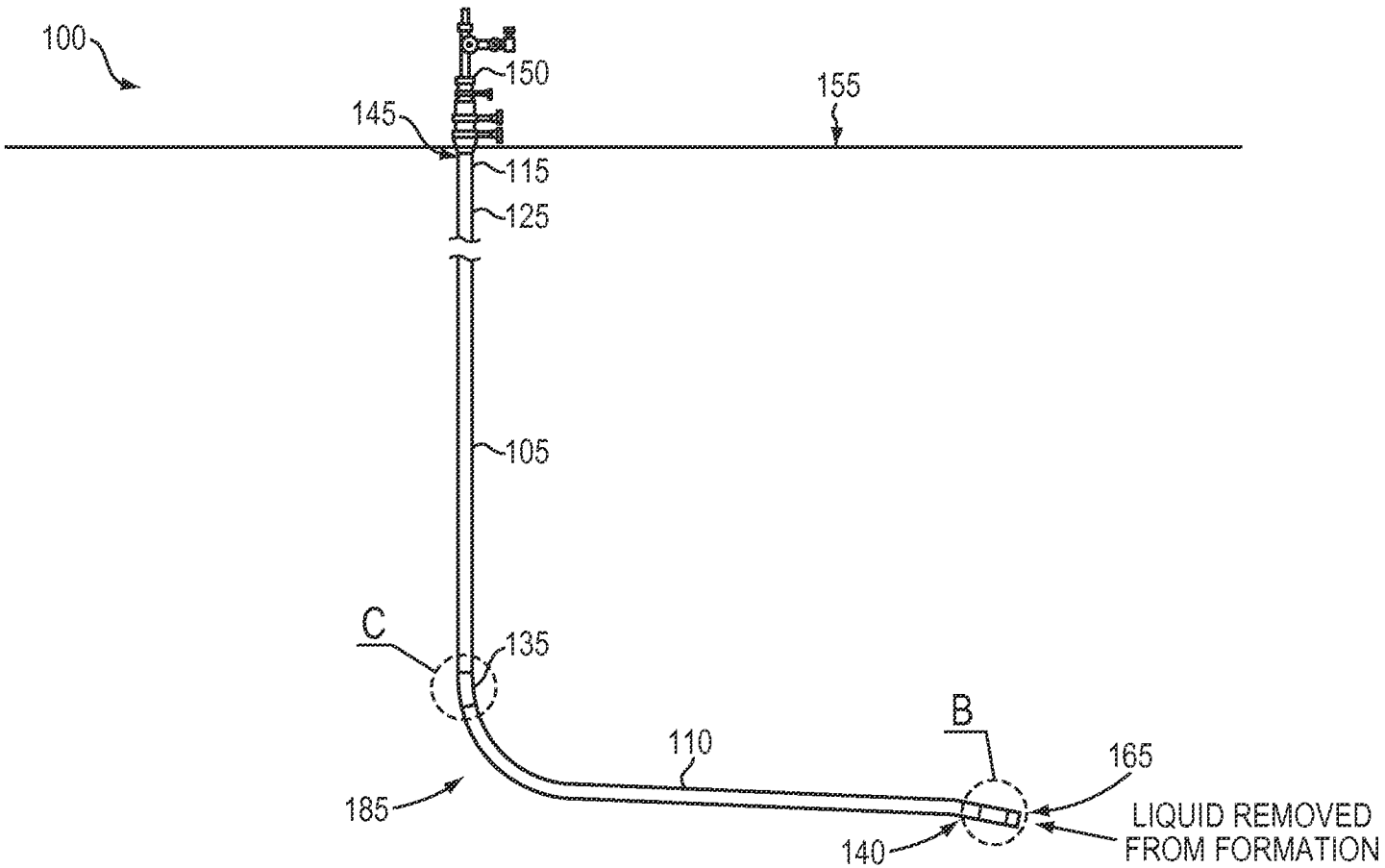
FIG. 1A is a schematic side view of an example system for removing a fluid from a subterranean well, in accordance with one embodiment of the invention.

To provide an overall understanding, certain illustrative embodiments will now be described; however, it will be understood by one of ordinary skill in the art that the systems and methods described herein can be adapted and modified to provide systems and methods for other suitable applications and that other additions and modifications can be made without departing from the scope of the systems and methods described herein.

Unless otherwise specified, the illustrated embodiments can be understood as providing exemplary features of varying detail of certain embodiments, and therefore, unless otherwise specified, features, components, modules, and/or aspects of the illustrations can be otherwise combined, separated, interchanged, and/or rearranged without departing from the disclosed systems or methods. Additionally, the shapes and sizes of components are also exemplary and unless otherwise specified, can be altered without affecting the scope of the disclosed and exemplary systems or methods of the present disclosure.

One embodiment of the invention relates to systems and methods for removing one or more liquids from a subterranean well (i.e., a deliquification system), and, more particularly, for subterranean wells having a horizontal, or substantially horizontal, distal portion. The subterranean well may, for example, include a well bore including a proximal section extending down from a surface region into a rock formation, and a distal, deviated well, section extending at an angle from the proximal portion into a portion of rock containing the desired fluid. In one embodiment, the proximal portion extends vertically down, or substantially vertically down, from the surface, creating a first substantially vertical section, while the distal portion extends horizontally, or substantially horizontally, from the proximal portion, with a curved portion therebetween. In alternative embodiments, the proximal portion and distal portion may extend at an angle to the horizontal and vertical, depending, for example, upon the specific geology of the rock formation through which the well bore passes and the location of the fluid source within the rock formation. For example, in one embodiment the proximal portion may extend at an angle of between approximately 0-10° from a vertical plane, while the distal portion extends at an angle of between approximately 0-10° from a horizontal plane. Such wells may be advantageous, for example, in gas producing shales having low permeability. In other embodiments, the proximal portion and the distal portion may both be substantially vertical. In still other embodiments, the proximal portion may be drilled at an angle for a significant distance before moving to a substantially horizontal orientation. For example, a well bore could be drilled for approximately 500 ft at about 10 degrees, increase for approximately 3000 ft to about 25 degrees, then turn through a large radius to a lateral, which might begin at around 80 degrees but slowly transition to about 85-90 degrees, or even past 90 degrees to around 100 degrees.

In one embodiment, the deliquification system includes two separate fluid removal technologies that may be used in tandem to remove an unwanted liquid from the well through both the substantially horizontal and vertical sections. The removal system may, for example, use a first removal device—such as, but not limited to, a small pump—to move unwanted liquid collected in the horizontal well section away from the formation and into the vertical, or substantially vertical, proximal portion of the well. This first removal device may only require enough pressure capability to move the liquid, e.g., water, a short way up the vertical section of the well. A secondary removal system may then be used to move the liquid to the surface through the vertical well section.

By using a two-stage removal process, with the removal device placed in the horizontal deviated well section only required to drive fluid from the deviated well section into the vertical well section, the removal device placed in the horizontal deviated well section can be significantly simpler and smaller than any device which is used to move the liquid to the surface through the vertical well section. These smaller and/or simpler devices are substantially easier to deploy into a deviated well section than devices that are adapted to transport fluid from the deviated well section to the surface in a single stage, and can therefore substantially reduce the cost and complexity of subterranean drilling using deviated well technology.

The system can be run either continuously or intermittently. For example, either one or both of the separate fluid removal means may be run, and may be run only enough to prevent any significant build up of unwanted liquids within the well. In certain embodiments, the system can include one or more down hole sensors to detect liquid build up and automate the running of the removal system.

In another embodiment, the first removal device/secondary pump system may be used to move fluid (e.g., water) from the well bore into an inner tube within the well bore. The second removal device/primary pump system may be used to lift the fluid to a wellhead. These devices may operate sequentially, e.g., the secondary pump system may force the water into the inner tube, at which point the primary pump system may force the water to the wellhead. A system sequencer or control system may be used to control, adjust, and/or optimize the operation of the primary and the secondary pumps.

The desired fluid which the subterranean well is recovering from the rock formation may include, or consist essentially of, one or more hydrocarbons. This hydrocarbon may be in a gaseous or liquid state within the rock formation. Example hydrocarbons (i.e., organic compounds containing carbon and hydrogen) include, but are not limited to, methane, ethane, propane, butane, pentane, hexane, heptane, octane, nonane, and/or decane. This desired fluid, or combination of fluids, is often mixed with other, often unwanted, fluids, such as liquid water. In alternative embodiments, the fluid source may include a mixture of liquids and gases, both of which may be desirable for removal from the rock formation.

In order to remove the desired fluid from the rock formation, the desired fluid may either be carried to the surface along with the unwanted fluid, or be separated from the unwanted fluid within the well. For example, if a rock formation contains both a desired gas and an unwanted liquid (e.g., water) the well may subject the gas/liquid mixture to enough pressure to lift both to the surface (with the gas and liquid separated at the surface), or the gas may be separated from the liquid so that the gas may be transported to the surface without having to additionally transport the unwanted liquid to the surface with the gas. If the gas and liquid are not separated, and if the well cannot generate sufficient pressure to lift both to the surface, the unwanted liquid can produce a back pressure preventing the desired gas, or gases, from passing up the well, thereby preventing the capture of the desired gas from the well.

Provided herein is a method of preventing or ameliorating such a back pressure by, e.g., introducing a deliquification system (i.e., a system for removing a fluid from a well) into the subterranean well to separate the desired fluid (e.g., hydrocarbon gases) from unwanted liquids (e.g., water held within the rock formation) within the well, and transport each to the surface separately.

Figure 1B:
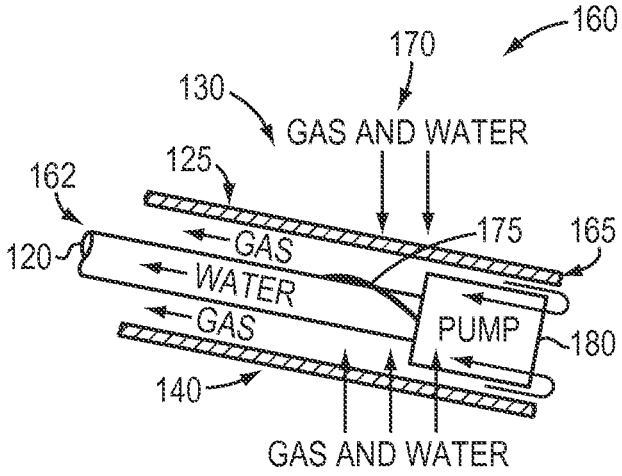
FIG. 1B is a schematic side view of a first fluid removal device for the system of FIG. 1A.
Figure 1C:
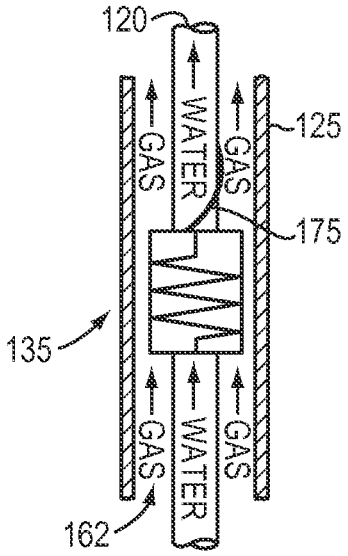
FIG. 1C is a schematic side view of a second fluid removal device for the system of FIG. 1A.

An example system for deliquifying fluids (i.e., removing one or more liquids from a fluid) in a subterranean well to facilitate removal of a desired fluid from the well is shown in FIGS. 1A-1C. In this embodiment, the deliquification system 100 includes a pipe 105 including a distal section 110, corresponding to a deviated well portion of a well, and a proximal section 115. The pipe 105 may include a hollow inner tubing string 120 and a well casing 125 surrounding the inner tubing string 120. In an alternative embodiment, multiple inner tubing strings 120 can extend within the well casing 125. In another embodiment, there may be a well casing annulus between the pipe 105 and the well casing 125.

The deliquification system 100 may also include a first fluid removal means (or secondary pump system) 130 within the distal section 110 of the pipe 105, and a second fluid removal means (or primary pump system) 135 within the proximal section 115 of the pipe 105. These first fluid removal means 130 and a second fluid removal means 135 may be positioned within the well casing 125 and are in fluidic communication with the interior of the inner tubing string 120. As a result, the first fluid removal means 130 and a second fluid removal means 135 may provide a means of pumping, or otherwise transporting, a fluid within the inner tubing string 120 from a distal end portion 140 of the pipe 105 to a proximal end 145 of the pipe 105. The first removal means 130 and/or second removal means 135 may include, or consist essentially of, a device such as, but not limited to, a reciprocating pump (e.g., a rod pump or a beam pump), a submersible electric pump, a progressive cavity pump, a plunger, a compressed gas pumping system, or a gas lift. The compressed gas pumping system may include, or consist essentially of, a device such as, but not limited to, a squeezable bladder operated with compressed gas, a piston driven by compressed gas, or a jet pump manipulating compressed gas.

In one embodiment, the proximal end 145 of the pipe 105 can be connected to a wellhead 150 located at a surface region 155 of a rock formation 160. The wellhead 150 can include separate fluid connections, allowing the various fluids exiting pipe 105 to be carried from the wellhead 150 through separate fluid transportation pipelines. An annulus 162 between the inner tubing string 120 and a well casing 125 may be adapted to transport the desired fluid from the distal section 110 to the proximal end 145 of the pipe 105, which may, for example be located at a surface of the rock formation 160. The inner tubing string 120 may be adapted to transport at least one unwanted liquid from the distal section 110 to the proximal end 145 of the pipe 105. The inner tubing string 120 may also be adapted to transport another medium, such as an injected compressed gas to be delivered to the second fluid removal means 135.

In operation, the first fluid removal means 130 may be adapted to pump, or otherwise transport, unwanted liquid that is collecting in the annulus 162 into the inner tubing string 120, and through the inner tubing string 120 from the distal section 110 to the second fluid removal means 135 in the proximal section 115 of the pipe 105. The second fluid removal means 135 can pump, or otherwise transport, the unwanted liquid through the inner tubing string 120 to the proximal end 145 of the pipe 105. As a result, the pressure within the well can be used to transport the desired fluid to the surface within the annulus 162, while the unwanted liquid is separated from the desired fluids by the first fluid removal means 130 and separately transported to the surface through the inner tubing string 120.

The first fluid removal means 130 may be located within the well casing 125 in the distal portion 110 of the pipe 105 and, more particularly, at or near a distal end 165 of the inner tubing string 120. Alternatively, the first fluid removal means 130 can be located within the well casing 125 away from the distal end portion 140 of the pipe 105. In one embodiment, as shown in FIGS. 1A and 1B, a section of the distal end portion 140 is oriented at an acute angle to a horizontal plane. In alternative embodiments, the entire distal end portion 140 may be substantially horizontal.

A producing zone 170 may be located in the distal end portion 140 of the pipe 105 and, for example, at or near the distal end 165 of the inner tubing string 120. This producing zone 170 may, for example, include one or more permeability regions or selectively perforated regions in the well casing 125 and/or open sections in the distal end 140 portion of the pipe 105. In operation, the producing zone 170 allows fluid from the target region of the rock formation to pass into the pipe 105.

The invention may include one or more power supplies to provide power to at least one of the first fluid removal means 130 and second fluid removal means 135. The at least one power supply may, for example, include at least one of an electrical power supply, a gas power supply, a compressed gas power supply, or a hydraulic power supply. In one embodiment, the first fluid removal means 130 and second fluid removal means 135 are powered by separate power supplies. In another embodiment, the second fluid removal means 135 are powered by compressed gas delivered via capillary tubes that may be embedded within the pipe 105. In an alternative embodiment, both the first fluid removal means 130 and second fluid removal means 135 are powered by the same power supply.

One embodiment of the invention may include one or more power couplings which can selectively allow power from the surface to be transmitted discretely to either the first fluid removal means 130 and/or second fluid removal means 135. For example, in one embodiment, where compressed gas is used to move a plunger to de-liquify a horizontal well section 110, a power coupling can be used to transmit power only to the first fluid removal means 130.

The power supply for each fluid removal means may be located at or near the surface 155 of the rock formation 160, and be connected to the fluid removal means through one or more energy conductors 175. The energy conductors 175 may be embedded within a wall of the inner tubing string 120, extend within the inner tubing string 120, and/or extend along the annulus 162 between the inner tubing string 120 and the well casing 125. Alternatively, the energy conductors 175 may be embedded within and/or extend outside, the well casing 125. The energy conductors 175 may, for example, include, or consist essentially of, at least one of a metallic wire, a metallic tube, a polymeric tube, a composite material tube, and/or a light guiding medium. In an alternative embodiment, power for one or both of the first fluid removal means 130 and second fluid removal means 135 may be located down well. For example, reservoir pressure from the fluid source may be used to power, or assist in powering, the first fluid removal means 130 and/or second fluid removal means 135. Alternatively, the first fluid removal means 130 and/or second fluid removal means 135 may include batteries located with the first fluid removal means 130 and second fluid removal means 135 to power elements thereof.

In one embodiment, one or more operations of the first fluid removal means 130 and/or second fluid removal means 135 may be controlled by one or more control systems. For example, a control system may be used to control power to the first fluid removal means 130 and/or second fluid removal means 135, thereby allowing the fluid removal means (130, 135) to be turned on and off and/or be adjusted to increase or decrease fluid removal, as required. The control system may turn the fluid removal means (130, 135) on and off in a sequential manner, such as turning the first fluid removal means 130 for a set amount of time or until a predetermined amount of fluid is advanced to the second fluid removal means 135, at which point the first fluid removal means 130 is turned off and then the second fluid removal means 135 is turned on to move the fluid to the surface 155. In one embodiment, a control system for both the first fluid removal means 130 and/or second fluid removal means 135 can be located at or near the surface 155 and be coupled to the power supply to control the power being sent to each fluid removal mean (130, 135). Alternatively, separate control systems may be associated with each of the first fluid removal means 130 and/or second fluid removal means 135. These control systems may either be located at the surface 155 or at a location down well.

In one embodiment, one or more sensors may be positioned at various points within the system to monitor various operational parameters of the system. For example, a sensor, such as, but not limited to, a current sensor, a voltage sensor, a pressure sensor, a temperature sensor, a flow meter (for both liquids and gases), and/or a chemical sensor may be positioned within the inner tubing string 120 and/or annulus 162 to monitor the flow of fluid therewithin. In one example embodiment, sensors located within the pipe 105 may be connected, for example wirelessly or through one or more energy conductors, to a control system, with the control system monitoring the conditions within the pipe 105 through the sensors and controlling operation of the first fluid removal means 130 and/or second fluid removal means 135 in response to the monitored readings (e.g., a pressure, temperature, flow rate, and/or chemical composition reading).

For example, in one embodiment, a sensor may be used to detect the presence of unwanted liquid within the annulus 162. Upon detection of an unwanted liquid of, for example, a predetermined volume or chemical composition, the control system may turn on the first fluid removal means 130 and/or second fluid removal means 135 to remove the unwanted liquid from the annulus 162 by pumping it into the inner tubing string 120 and transporting it to the surface 155. In an alternative embodiment, the control system may be used to adjust a pumping rate of the first fluid removal means 130 and/or second fluid removal means 135 to compensate for changes in a monitored condition. In other embodiments, the control system controls, adjusts, and/or optimizes a frequency, a timing, and/or a duration of the sequential operation of the removal means (130, 135).

In various embodiments of the invention, the first fluid removal means 130 and/or second fluid removal means 135 may be configured to operate continuously at a set rate, without the need for adjustment or other control, or to operate cyclically/sequentially by turning on and off (or increasing or decreasing power) on a predetermined schedule. Alternatively, the first fluid removal means 130 and/or second fluid removal means 135 may be configured to turn on and off, and/or increase and decrease power, based on a signal from a control system in response to the presence of, or change in, a monitored condition. In further embodiments, the first fluid removal means 130 and/or second fluid removal means 135 may operate in accordance with both a preset performance requirement and an adjustable performance requirement, such as to operate sequentially. As a result, the pumping of unwanted liquid from the annulus 162 may be monitored and controlled sufficiently to prevent a build up of unwanted liquid within the annulus 162 which could disrupt or even completely prevent the capture of desired fluids from the well.

In various embodiments of the invention, the inner tubing string 120 may include, or consist essentially of, a single continuous spoolable tube, or a plurality of connected spoolable tubing sections. The spoolable tube may, for example, be a composite tube comprising a plurality of layers. An example inner tubing string 120, in accordance with one embodiment of the invention, may include a multi-layered spoolable tube including layers such as, but not limited to, an internal barrier layer, one or more reinforcing layers, an abrasion resistant layer, and/or an external/outer protective layer.

Example internal pressure barrier layers can, for example, include a polymer, a thermoset plastic, a thermoplastic, an elastomer, a rubber, a co-polymer, and/or a composite. The composite can include a filled polymer and a nano-composite, a polymer/metallic composite, and/or a metal (e.g., steel, copper, and/or stainless steel). Accordingly, an internal pressure barrier can include one or more of a high density polyethylene (HDPE), a cross-linked polyethylene (PEX), a polyvinylidene fluoride (PVDF), a polyamide, polyethylene terphthalate, polyphenylene sulfide and/or a polypropylene.

Exemplary reinforcing layers may include, for example, one or more composite reinforcing layers. In one embodiment, the reinforcing layers can include fibers having a cross-wound and/or at least a partially helical orientation relative to the longitudinal axis of the spoolable pipe. Exemplary fibers include, but are not limited to, graphite, KEVLAR, fiberglass, boron, polyester fibers, polymer fibers, mineral based fibers such as basalt fibers, and aramid. For example, fibers can include glass fibers that comprise e-cr glass, Advantex®, s-glass, d-glass, or a corrosion resistant glass. The reinforcing layer(s) can be formed of a number of plies of fibers, each ply including fibers.

In some embodiments, the abrasion resistant layer may include a polymer. Such abrasion resistant layers can include a tape or coating or other abrasion resistant material, such as a polymer. Polymers may include polyethylene such as, for example, high-density polyethylene and cross-linked polyethylene, polyvinylidene fluoride, polyamide, polypropylene, terphthalates such as polyethylene therphthalate, and polyphenylene sulfide. For example, the abrasion resistant layer may include a polymeric tape that includes one or more polymers such as a polyester, a polyethylene, cross-linked polyethylene, polypropylene, polyethylene terphthalate, high-density polypropylene, polyamide, polyvinylidene fluoride, polyamide, and an elastomer.

Exemplary external layers can bond to a reinforcing layer(s), and in some embodiments, also bond to an internal pressure barrier. In other embodiments, the external layer is substantially unbonded to one or more of the reinforcing layer(s), or substantially unbonded to one or more plies of the reinforcing layer(s). The external layer may be partially bonded to one or more other layers of the pipe. The external layer(s) can provide wear resistance and impact resistance. For example, the external layer can provide abrasion resistance and wear resistance by forming an outer surface to the spoolable pipe that has a low coefficient of friction thereby reducing the wear on the reinforcing layers from external abrasion. Further, the external layer can provide a seamless layer to, for example, hold the inner layers of a coiled spoolable pipe together. The external layer can be formed of a filled or unfilled polymeric layer. Alternatively, the external layer can be formed of a fiber, such as aramid or glass, with or without a matrix. Accordingly, the external layer can be a polymer, thermoset plastic, a thermoplastic, an elastomer, a rubber, a co-polymer, and/or a composite, where the composite includes a filled polymer and a nano-composite, a polymer/metallic composite, and/or a metal. In some embodiments, the external layer(s) can include one or more of high density polyethylene (HDPE), a cross-linked polyethylene (PEX), a polyvinylidene fluoride (PVDF), a polyamide, polyethylene terphthalate, polyphenylene sulfide and/or a polypropylene.

In various embodiments, the pipe 105 may include one or more energy conductors (e.g. power and/or data conductors) to provide power to, and provide communication with, the first fluid removal means 130, second fluid removal means 135, sensors, and/or control systems located within the pipe 105. In various embodiments, energy conductors can be embedded within the inner tubing string 120 and/or well casing 125, extend along the annulus between the inner tubing string 120 and/or well casing 125, and/or extend within the inner tubing string 120 or outside the well casing 125. In one example embodiment, the inner tubing string 120 may include one or more integrated pressure fluid channels to provide power to the first fluid removal means 130 and/or second fluid removal means 135.

In one embodiment, the fluid removal means are adapted to assist in the transport of fluids and, for example, unwanted or desired liquids, through the inner tubing string 120. In an alternative embodiment, the fluid removal means may be adapted to assist in the transport of fluids and, for example, unwanted or desired liquids, through the annulus 162, with the desired fluids being transported to the surface through the inner tubing string or strings 120.

One embodiment of the invention may include the use of three or more fluid removal means. For example, a system may include an additional fluid removal means located within the pipe 105 between the first fluid removal means 130 and the second fluid removal means 135, to assist in transporting the fluid therebetween. Alternatively, or in addition, one or more additional fluid removal means may be positioned between the second fluid removal means 135 and the surface 155, or between a distal end 165 of the pipe 105 and the first fluid removal means 130. As before, these additional fluid removal means may include at least one of a mechanical pump, a reciprocating rod pump, a submersible electric pump, a progressive cavity pump, a plunger, a compressed gas pumping system, or a gas lift.

In certain embodiments, separate fluid removal means may be associated with both the inner tubing string 120 and the annulus 162, thereby assisting in the transport of fluids through both the inner tubing string 120 and the annulus 162.

In various embodiments of the invention, the first fluid removal means 130 may include, or consist essentially of, a device such as, but not limited to, a reciprocating rod pump, a submersible electric pump, a progressive cavity pump, a plunger, a compressed gas pumping system, or a gas lift. For example, in one embodiment, as shown in FIGS. 1A-1C, the first fluid removal means 130 is a pump 180. The pump 180 may, for example, be powered by an electric motor (ESP) and/or a gas or hydraulic supply. In operation, the pump 180, or a similar liquid removal device, may be coupled to the distal end 165 of the inner tubing string 120 and inserted into the well casing 125. The pump 180 may then be pushed down to the distal end portion 140 as the inner tubing string 120 is fed down the well casing 125. The pump 180 may be pushed past the producing zone 170 in the deviated well section 110. Once in position, the pump 180 may pump unwanted liquids located within the annulus 162 into the inner tubing string 120, thereby allowing the unwanted liquids to pass up the inner tubing string 120 and, as a result, allowing the desired fluids in the annulus 162 to be transported up the annulus 162 without their path being blocked by back pressure created by unwanted liquids in the annulus 162.

In contrast to using larger pumps that may have enough pressure capability to overcome the entire static pressure head within the system, the present invention, in some embodiments, uses multiple fluid removal means deployed at various stages of the pipe 105 (e.g., with one smaller fluid removal means 130 located in the deviated well section 110 and a second fluid removal means 135 located in the substantially vertical proximal section 115). As a result, a smaller pump, or similar fluid removal means, sized only large enough to gather the unwanted liquid from the deviated well section 110 and transport it to the proximal section 115, may be utilized within the deviated well section 110. Using a smaller fluid removal means, which would require significantly less power, within the deviated well section 105 may significantly reduce the complexity of separating unwanted liquids from the desired fluids within the deviated well section 110. The unwanted liquids can then be transported out of the pipe 105 through the proximal section 115 using the second fluid removal means 135 which, as it can be located within the substantially vertical proximal section 115, may be larger, more powerful, and, for example, gravity assisted.

In one embodiment, the fluid removal means 130 has sufficient power to force the unwanted liquid around the curved portion 185 of the deviated well section 110 and a short distance up the substantially vertical proximal section 115, until there is insufficient pressure to overcome the static head. The separate second fluid removal means 135 may then be used to lift the unwanted liquid gathered in the vertical section to the surface region 155. This second fluid removal means 135 may be selected to have sufficient power to overcome the static head.

In various embodiments of the invention, the second fluid removal means 135 may include, or consist essentially of, a device such as, but not limited to, a reciprocating rod pump, a submersible electric pump, a progressive cavity pump, a plunger, a compressed gas pumping system, or a gas lift. For example, in one embodiment, the second fluid removal means 135 is a plunger-type system. The plunger may, for example, include one or more valve elements that are adapted to allow unwanted liquid from the deviated well section 110 of the inner tubing string 120 to pass upwards through, or around, the plunger towards a proximal end. Once the unwanted liquid is positioned above the plunger, the plunger can be operated to lift the liquid up the proximal section 115 to the surface 155. The valve may, for example, be sealable so that pressure can be applied behind the plunger to lift a column of liquid above the plunger to the surface 155. In various embodiments, the plunger may be driven by a compressed gas supply coupled to the proximal end of the pipe 105 which may, for example, be connected to the plunger through at least one energy conductor 175. Alternatively, the plunger may be driven by gas pressure from the fluid reservoir in the rock formation.

Figure 2A:
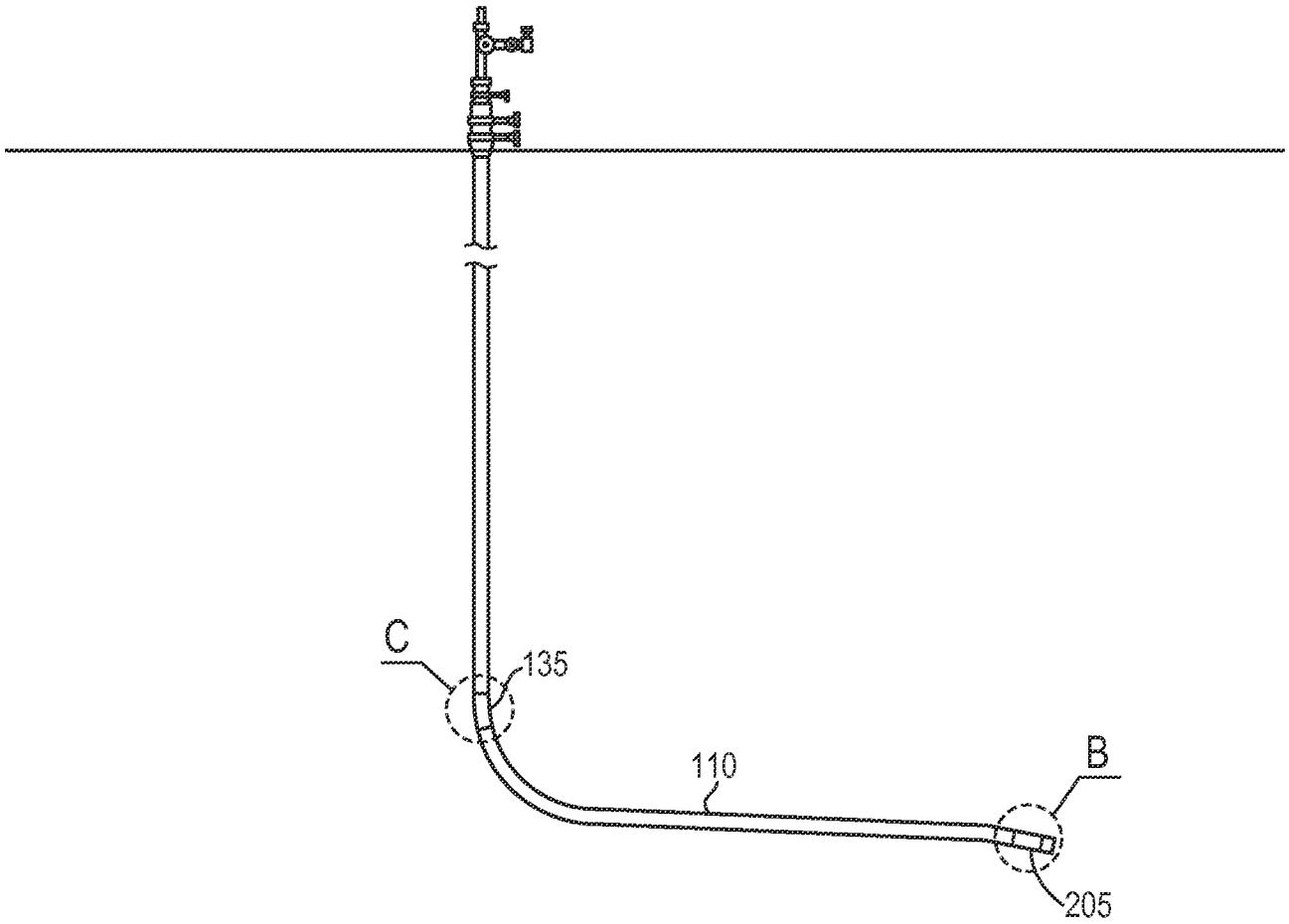
FIG. 2A is a schematic side view of another example system for removing a fluid from a subterranean well, in accordance with one embodiment of the invention.
Figure 2B:
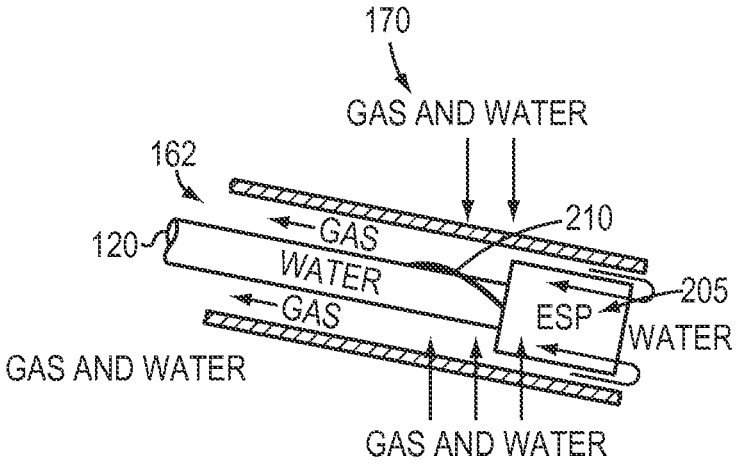
FIG. 2B is a schematic side view of a first fluid removal device for the system of FIG. 2A.
Figure 2C:
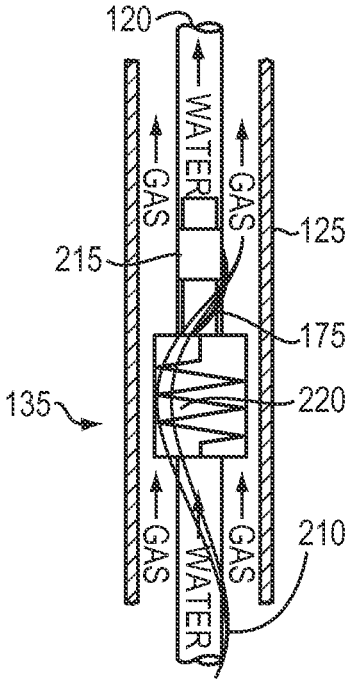
FIG. 2C is a schematic side view of a second fluid removal device for the system of FIG. 2A.

In one example embodiment of the invention, as shown in FIGS. 2A to 2C, the first fluid removal means is an electric submersible pump (ESP) 205. This ESP 205 may be used to remove liquid from the horizontal, or substantially horizontal, deviated well section 110 of the pipe 105. One or more energy conductors 210 may extend within the annulus 162 to provide power to, and/or control of, the ESP 205. As before, the internal tubing string 120 may be a continuous, spoolable tube and, for example, a composite, multi-layered tube.

In operation, the ESP 205 may be attached to a distal end of the internal tubing string 120, inserted into the well casing 125, and pushed into place using the internal tubing string 120. The ESP 205 may have sufficient head pressure to move the unwanted liquid, e.g., water, through the deviated well section 110 and part way up the vertical section 115 of the well. The unwanted liquid can then be progressively removed from the substantially vertical section 115 using a second fluid removal means 135.

In the embodiment shown in FIGS. 2A to 2C, the second fluid removal means 135 includes a plunger 215. Using a system of controls, the plunger 215 may be arranged so that it falls under gravity when the vertical section is empty to a rest position set, for example, by a plunger catcher 220. A valve and cross over system may be arranged within the plunger 215 and/or plunger catcher 220 so that liquid pumped from the deviated well section 110 by the ESP 205 can pass above the plunger 215 for removal.

The plunger 215 may be configured to operate continuously, at regular intervals, and/or upon certain criteria being met. For example, the plunger 215 may be configured to operate only when one or more monitored conditions within the pipe 105 are sensed by one or more sensors placed within the pipe 105 (e.g., within the internal tubing string 120 and/or the well casing 125). At an appropriate time, e.g., when a sufficient unwanted liquid column has gathered in the vertical section 115, well pressure generated within the pipe 105 (e.g., by the transport of the desired fluid from the production zone) may be applied to the plunger 215 to lift this column of liquid to the surface 155 where it is gathered and separated from the desired fluid (e.g., a hydrocarbon gas). The plunger 215 may then be allowed to fall back to the rest position and the cycle recommences. In another embodiment, the plunger 215 may be powered by compressed gas fed from the surface 155, eliminating the need to wait on sufficient well pressure to build. In another embodiment, the compressed gas is supplied by one or more small tubes (e.g., capillary tubes) integrated into, or extending around, the inner tubing string 120.

Figure 3A:
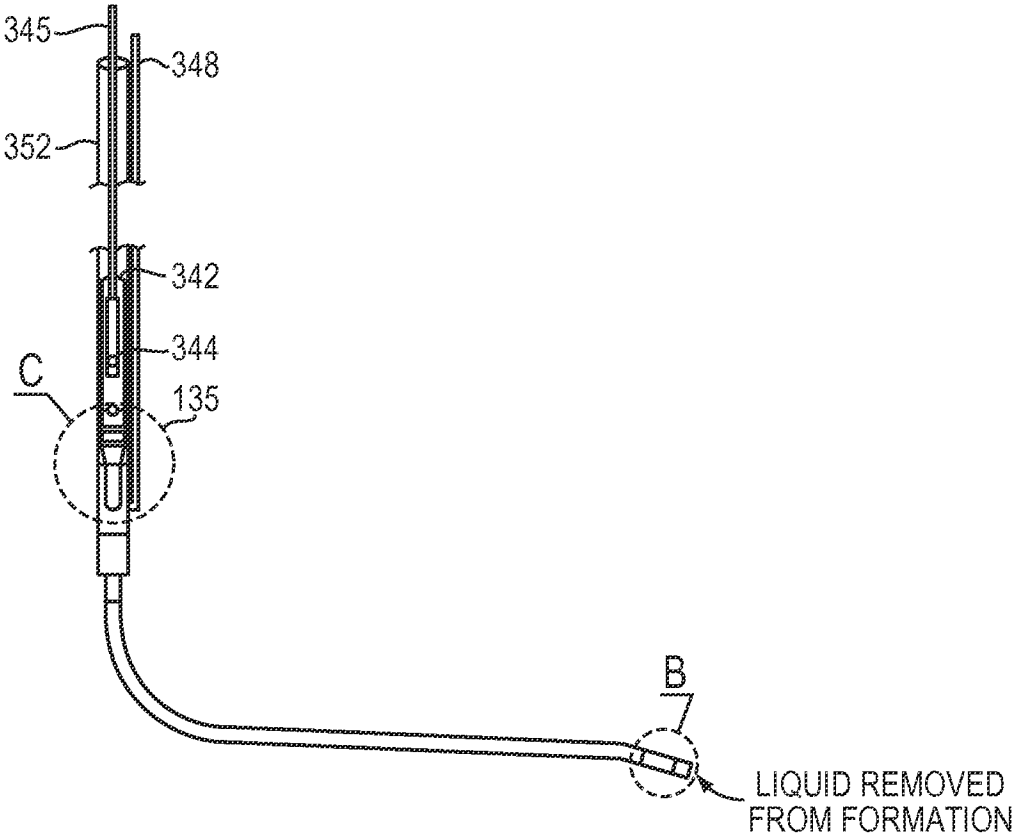
FIG. 3A is a schematic side view of another example system for removing a fluid from a subterranean well, in accordance with one embodiment of the invention.
Figure 3B:
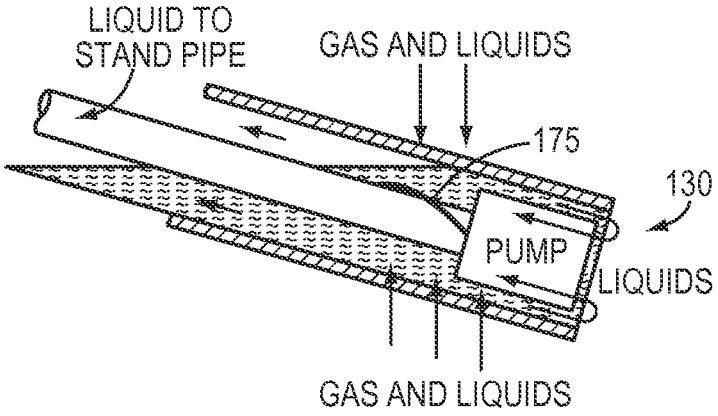
FIG. 3B is a schematic side view of a first fluid removal device for the system of FIG. 3A.
Figure 3C:
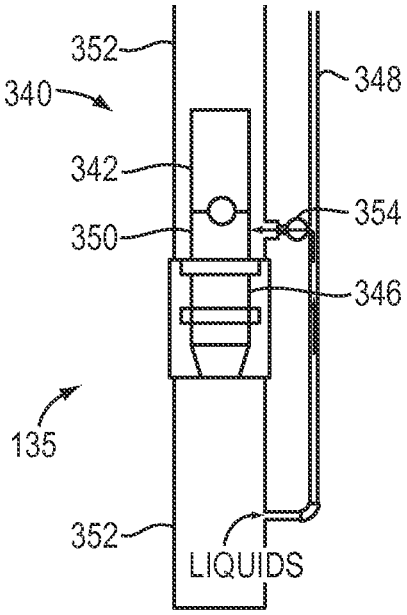
FIG. 3C is a schematic side view of a second fluid removal device for the system of FIG. 3A.

In another embodiment, as depicted in FIGS. 3A to 3C, the second fluid removal means 135 includes a beam pump 340. The beam pump 340 may include a beam pump tube 342, a travelling valve 344 coupled to a sucker rod 345, a seating nipple 346, and a stand pipe 348. A distal end of the beam pump tube 342 may sealingly engage the seating nipple 346, preventing fluid from entering or exiting the beam pump tube 342 other than where desired, such as a pump intake 350. The seating nipple 346 may secure separate portions of tubing 352 that fit within the well casing. At least one area of each of the tubing portions 352 may be fluidically coupled to the stand pipe 348. The stand pipe 348 may also extend to the surface and be open to the atmosphere to allow for the release of excess fluid pressure. The stand pipe 348 may also include a check valve 354 to prevent backflow of fluid.

The beam pump 340 may draw fluid into the beam pump tube 342 when the sucker rod 345 moves in an upward direction, thereby raising the travelling valve 344 and lowering the pressure within the beam pump tube 342. The fluid may flow vertically through the standpipe 348, through the check valve 354, and into the beam pump tube 342 via the pump intake 350. This process may also be aided by the first fluid removal means 130. On a downward stroke of the sucker rod 345, fluid may be forced through the travelling valve 344 onto an upper side thereof, the fluid prevented from moving back down the standpipe 348 by the check valve 354. This process may be repeated to continuously remove unwanted fluid to the surface. While the unwanted fluid is being removed, a desired substance, e.g., hydrocarbon gas, may be produced to the surface around the beam pump 340.

In another embodiment utilizing a beam pump, the desired fluid may be produced on the exterior of the beam pump assembly. The unwanted liquid may be forced into a tube from the first fluid removal means. The tube may have a check valve to prevent any unwanted liquid in the tube from flowing back toward the first removal means. The beam pump may have a travelling valve that sealingly engages the inner circumference of the tube. As the travelling valve moves up and down (as controlled through a sucker rod which may be powered from above, i.e., the surface), it forces liquid from below the travelling valve within the tube to above the travelling valve. This process is repeated to remove the unwanted liquid from the well. The desired fluid may then be produced through an annulus between the tube and a well to the surface.

In an alternative embodiment, the unwanted liquid gathered in the inner tubing string 120 is removed by a gas lift system where gas is pumped down the well in one or more small capillary tubes, and returns to the surface 155 at sufficient velocity to carry liquid droplets to the surface 155. This gas tube may be positioned where it will propel all the liquid in the inner tubing string 120, including the unwanted liquid in the deviated well section 110, or so that it propels only part of this column to the surface (e.g., only the water gathered in the vertical section 115).

In another embodiment, unwanted liquid (e.g., water) is removed from the water bore by a combined sequential lift system. The combined sequential lift system includes a primary pump system 135 capable of lifting fluid from significant depths (i.e., greater than approximately 1,000 feet) to a wellhead 150, and a secondary pump system 130 capable of removing water from the well bore into an inner tube 120. The primary pump system 135 may be placed above or in the radial section of the well bore. In some embodiments, the secondary pump system 130 is sized such that it can be placed in the lateral deviated well section 110 and move water through the well bore to at least a level between the surface 155 and the primary pump system 135. In some embodiments, the secondary pump system 130 is sized such that it cannot move water all the way to the surface 155 without the assistance of the primary pump system 135. The primary pump system 135 may, for example, have the capability to move the water to the surface 155.

The primary pump system 135 may be any of a variety of pumps as previously described with respect to other embodiments, including a plunger or a reciprocating beam pump. The secondary pump system 130 may be attached to the inner tube 120, typically below the primary pump system 135 and in a horizontal or deviated section of the well bore. The secondary pump system 130 may include check valves to prevent backflow of water, such as water flowing back into the well bore from the inner tube 120 and water flowing back down the inner tube 120 after already advancing toward the surface 155. The secondary pump system 130 may include a compressed gas pump and a compressed gas. The compressed gas may be used to squeeze a bladder to lift water to the primary pump system 135, to power a piston to lift water to the primary pump system 135, or to directly move the water through a jet pump to the primary pump system 135. The compressed gas may be supplied through small capillary tubes integral with or connected to the inner tube 120 or directly through the inner tube 120. The inner tube 120 may include a cross-over system which re-routes water from the inside to the outside of the inner tube 120, and vice-versa. This cross-over system may be placed at a set point in the well bore and attached to the inner tube 120, providing separate channels for reversing (or swapping) the flow of water and another quantity, such as the compressed gas. This setup allows for water and the compressed gas to both use separate portions of the inner tube 120.

The combined sequential lift system may operate sequentially, relying upon a system sequencer to control, adjust, and/or optimize the sequential operation of the primary and the secondary pump systems (135, 130). This sequential operation may include activating the secondary pump system 130 to move water to the primary pump system 135, then turning off the secondary pump system 130 and activating the primary pump system 135 to move water to the wellhead 150. The primary pump system 135 may then be deactivated and the secondary pump system 130 reactivated to restart the process of removing water from the well bore. The system sequencer may monitor well parameters (e.g., current, voltage, gas flow, fluid flow, pressure, temperature) to control the frequency and/or timing of the primary and secondary pump systems (135, 130).

In operation, the systems described herein may be utilized to remove one or more unwanted liquids from a subterranean well, thereby facilitating removal of a desired fluid. The systems may be deployed and operated by first inserting a pipe 105 comprising at least one inner tubing string 120 and a well casing 125 into a rock formation 160 such that a distal portion of the pipe 105 extends into a fluid source within a rock formation 160. This may be achieved, for example, by first drilling a bore hole in the rock formation 160 and then inserting the well casing 125 into the bore hole. The inner tubing string 120, which may, for example, be a spoolable tube, may then be unspooled and deployed down through the well casing 125, with an open annulus 162 formed between the outer wall of the inner tubing string 120 and the inner wall of the well casing 125. The well may, for example, include a proximal well section 115 extending from a surface 155 of the rock formation 160 and a substantially horizontal deviated well section 110 extending from the proximal well section 115 to the fluid source.

Once deployed, the system can transport at least one fluid (e.g., an unwanted liquid) through the inner tubing string 120 from the fluid source to the proximal well section 115 using a first fluid removal means 130. The unwanted liquid may then be transported through the inner tubing string 120 from the proximal well section 115 to a proximal end 145 of the pipe 105 using a second fluid removal means 135. Simultaneously, or at separate discrete intervals, a separate desired fluid (e.g., a hydrocarbon gas) may be transported from the fluid source to the proximal end 145 of the pipe 105 through the annulus 162 between the inner tubing string 120 and the well casing 125. In one embodiment, the desired fluid may be transported to the surface 155 through application of reservoir pressure from the fluid source in the rock formation 160. In an alternative embodiment, a fluid removal means may be used to assist in the transport of the desired fluid to the surface 155 through the annulus 162.

In other embodiments, the unwanted liquid may be transported through a pipe annulus between the inner tubing string 120 and the pipe 105, while an injected gas for operating the secondary pump system flows through the inner tubing string 120. The injected gas may be restricted to the inner tubing string 120, providing a direct link between a power supply and the first fluid removal means 130. In an alternative embodiment, the inner tubing string 120 includes a crossover device for re-routing fluid from inside to outside the inner tubing string 120 (and vice-versa), such as the injected gas and the unwanted fluid. In this setup, the injected gas and the unwanted fluid may flow through different portions of the inner tubing string 120. In still other embodiments, the desired fluid may flow through a well casing annulus between the pipe 105 and the well casing 125.

In an alternative embodiment, the unwanted liquid may be transported to the surface 155 through the annulus 162, with a first fluid removal means 130 and second fluid removal means 135 adapted to assist in the raising the liquid through the annulus 162. The desired fluid can then be transported to the surface through the inner tubing string 120.

One embodiment of the invention may include multiple inner tubing strings 120 extending within a well casing 125 to a fluid source in a rock formation 160. These multiple inner tubing strings 120 may, for example, have separate first and second fluid removal means (130, 135) associated with them, or be coupled to the same first fluid removal means 130 and/or second fluid removal means 135. The various inner tubing strings 120 may be used to transport different fluids from the fluid source to the surface, or to transport various combinations of the fluids.

In one embodiment, the inner tubing string 120 and annulus 162 may be used to separately transport two desired fluids (such as a desired liquid and a desired gas) to a surface 155 of a rock formation 160. The desired liquid may include, for example, a hydrocarbon and/or water. The desired gas may include a hydrocarbon.

REFERENCES

All publications and patents mentioned herein, including those items listed below, are hereby incorporated by reference in their entirety as if each individual publication or patent was specifically and individually incorporated by reference. In case of conflict, the present application, including any definitions herein, will control.

U.S. Pat. No. 6,016,845
U.S. Pat. No. 6,148,866
U.S. Pat. No. 6,286,558
U.S. Pat. No. 6,357,485
U.S. Pat. No. 6,604,550
U.S. Pat. No. 6,857,452
US2008/0720029
U.S. Pat. No. 5,921,285
U.S. Pat. No. 5,176,180
U.S. Pat. No. 6,004,639
U.S. Pat. No. 6,361,299
U.S. Pat. No. 6,706,348
US2008/0949091
US2008/0721135
US2007/0125439
U.S. Pat. No. 6,663,453
U.S. Pat. No. 6,764,365
U.S. Pat. No. 7,029,356
U.S. Pat. No. 7,234,410
U.S. Pat. No. 7,285,333
US2005/0189029

EQUIVALENTS

While specific embodiments of the subject invention have been discussed, the above specification is illustrative and not restrictive. Many variations of the invention will become apparent to those skilled in the art upon review of this specification. The full scope of the invention should be determined by reference to the claims, along with their full scope of equivalents, and the specification, along with such variations.

Unless otherwise indicated, all numbers expressing quantities of ingredients, reaction conditions, and so forth used in the specification and claims are to be understood as being modified in all instances by the term "about." Accordingly, unless indicated to the contrary, the numerical parameters set forth in this specification and attached claims are approximations that may vary depending upon the desired properties sought to be obtained by the present invention.

The terms "a" and "an" and "the" used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided herein is intended merely to better illuminate the invention and does not pose a limitation on the scope of the invention otherwise claimed. No language in the specification should be construed as indicating any non-claimed element essential to the practice of the invention.

Having described certain embodiments of the invention, it will be apparent to those of ordinary skill in the art that other embodiments incorporating the concepts disclosed herein may be used without departing from the spirit and scope of the invention. Accordingly, the described embodiments are to be considered in all respects as only illustrative and not restrictive.

What is claimed is:

1. A method of removing fluids from a subterranean well, comprising:

inserting at least one inner tubing string through a well having one or more well casings, the well having a distal portion that extends into a fluid source within a rock formation, wherein the well comprises a proximal well section extending from a surface of the rock formation and a deviated well section extending from the proximal well section to the fluid source, wherein the deviated well section extends at an angle from the proximal well section;

transporting at least one unwanted liquid through the inner tubing string from the fluid source to the proximal well section using a first fluid removal device, wherein the first fluid removal device is located in the deviated well section, the first fluid removal device having a pumping power sufficient to transport the at least one unwanted liquid from the fluid source to the proximal well section but insufficient to transport the at least one unwanted liquid through the proximal well section to a proximal end of the inner tubing string;

transporting the at least one unwanted liquid through the inner tubing string through the proximal well section to the proximal end of the inner tubing string using a second fluid removal device, wherein the second fluid removal device is located in the proximal well section in a substantially vertical orientation, the second fluid removal device having a pumping power sufficient to transport the at least one unwanted liquid through the proximal well section to the proximal end of the inner tubing string; and transporting a desired fluid from the fluid source to the proximal end of the well through an annulus between the inner tubing string and the well casing.

2. The method of claim 1, wherein each of the first fluid removal device and the second fluid removal device comprises at least one of a mechanical pump, a reciprocating rod pump, a submersible electric pump, a progressive cavity pump, a plunger, a compressed gas pumping system, or a gas lift.

3. The method of claim 1, wherein the first fluid removal device and second fluid removal device comprise the same form of fluid removal device.

4. The method of claim 1, wherein the first fluid removal device and second fluid removal device comprise different forms of fluid removal device.

5. The method of claim 4, wherein the first fluid removal device comprises an electric submersible pump and the second fluid removal device comprises a plunger lift.

6. The method of claim 1, further comprising monitoring at least one property of at least one of the unwanted liquid and the desired fluid.

7. The method of claim 6, wherein the monitored property comprises at least one of a pressure, a temperature, a flow rate, or a chemical composition.

8. The method of claim 1, further comprising controlling an operation of at least one of the first fluid removal device and the second fluid removal device using a control system.

9. The method of claim 8, wherein the control system powers at least one of the first fluid removal device and the second fluid removal device in response to at least one monitored condition within at least one of the inner tubing string and the well casing.

10. The method of claim 8, wherein the control system provides power to at least one of the first fluid removal device and the second fluid removal device.

11. The method of claim 1, wherein the step of transporting the at least one unwanted liquid through the inner tubing string through the proximal well section to the proximal end of the inner tubing string using a second fluid removal device is performed when a predetermined volume of unwanted liquid is detected within the proximal well section of the inner tubing string.

12. The method of claim 1, wherein at least a portion of the deviated well section is substantially horizontally oriented.

13. The method of claim 1, wherein at least a portion of the proximal well section is substantially vertically oriented.

14. The method of claim 1, wherein the first fluid removal device is located within the well at a distal portion of the inner tubing string.

15. The method of claim 1, wherein the distal portion of the deviated well section is oriented at an acute angle to a horizontal plane.

16. The method of claim 1, wherein the well casing comprises at least one selectively perforated portion to allow ingress of fluids from outside the casing.

17. The method of claim 1, wherein the well casing comprises a producing zone proximate the first fluid removal device.

18. The method of claim 1, wherein the inner tubing string comprises a single continuous spoolable tube.

19. The method of claim 1, wherein the inner tubing string comprises a plurality of connected spoolable tubing sections.

20. The method of claim 1, wherein the inner tubing string comprises a multi-layered tube.

21. The method of claim 1, further comprising providing at least one valve within the inner tubing string between the first fluid removal device and the second fluid removal device.

22. The method of claim 1, further comprising at least one valve within the inner tubing string between the second fluid removal device and a proximal end of the inner tubing string.

23. The method of claim 1, wherein the desired fluid is a gas or liquid hydrocarbon.

24. The method of claim 1, wherein the proximal well section extends at an angle from a vertical plane in the range of about 0° to about 10° and the deviated well section extends at an angle from a horizontal plane in the range of about 0° to about 10°.

25. The method of claim 1 further comprising a curved well section disposed between the proximal well section and the deviated well section.

26. The method of claim 1, wherein the second fluid removal device is gravity assisted.

27. The method of claim 26, wherein the first fluid removal device comprises at least one of a mechanical pump, a reciprocating beam pump, a submersible electric pump, a progressive cavity pump, a plunger, a compressed gas pumping system, or a gas lift and wherein the second fluid removal device comprises at least one of a plunger or a reciprocating beam pump.

28. The method of claim 27, wherein the first fluid removal device and second fluid removal device comprise the same form of fluid removal device.

* * * * *